US011506002B2

(12) United States Patent
Simanjuntak et al.

(10) Patent No.: US 11,506,002 B2
(45) Date of Patent: Nov. 22, 2022

(54) SYSTEMS, DEVICES, AND METHODS TO DETECT PIPE WITH A GRIPPERHEAD

(71) Applicant: Nabors Drilling Technologies USA, Inc., Houston, TX (US)

(72) Inventors: Godwin Simanjuntak, Tomball, TX (US); Christopher Magnuson, Houston, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 112 days.

(21) Appl. No.: 16/116,199

(22) Filed: Aug. 29, 2018

(65) Prior Publication Data

US 2019/0078400 A1 Mar. 14, 2019

Related U.S. Application Data

(60) Provisional application No. 62/556,802, filed on Sep. 11, 2017.

(51) Int. Cl.

| | |
|---|---|
| ***E21B 19/06*** | (2006.01) |
| ***E21B 19/14*** | (2006.01) |
| ***E21B 41/00*** | (2006.01) |
| ***E21B 19/15*** | (2006.01) |

(52) U.S. Cl.

CPC ..... *E21B 19/06* (2013.01); *E21B 19/14* (2013.01); *E21B 19/15* (2013.01); *E21B 41/00* (2013.01)

(58) Field of Classification Search

CPC ..... E21B 19/06; E21B 41/00; E21B 19/00; E21B 19/02; E21B 19/07; E21B 19/10; E21B 19/18; E21B 19/20; E21B 19/24; E21B 19/14; E21B 19/15; E21B 19/16

USPC ..... 294/194–201

See application file for complete search history.

(56) References Cited

U.S. PATENT DOCUMENTS

| | | | |
|---|---|---|---|
| 2,544,639 | A | 1/1946 | Calhoun |
| 2,450,934 | A | 5/1946 | Calhoun |
| 2,705,614 | A | 5/1949 | McKibben et al. |
| 2,871,743 | A | 2/1958 | Kelley |
| 3,500,708 | A | 5/1967 | Wilson |
| 3,803,953 | A | 4/1974 | Geczy et al. |
| 4,295,527 | A | 10/1981 | Russe |
| 4,348,920 | A | 9/1982 | Boyadjieff |

(Continued)

*Primary Examiner* — Robert E Fuller
*Assistant Examiner* — Lamia Quaim
(74) *Attorney, Agent, or Firm* — Haynes and Boone, LLP

(57) ABSTRACT

The systems, devices, and methods described herein relate to tubular detection on a gripperhead system for a drilling rig. The gripperhead system includes a grabber and a gripper each having first and second grabber arm and pistons connected to the first and second arms. Each arm may also include an inwardly facing gripping surface forming at least a portion of a chamber sized to receive a portion of a cylindrical tubular. One or more sensors may be disposed on the gripperhead system, including proximity sensors disposed on the arms, inductive sensors disposed within the pistons, and ultrasonic sensors disposed on other features of gripperhead system. The one or more sensors may be configured to determine the position of the tubular in relation to the arms, measure the size of the tubular, measure the compression force of the grabber, and ensure that the tubular is secured within the grabber.

27 Claims, 17 Drawing Sheets

(56) References Cited

U.S. PATENT DOCUMENTS 4,604,724 A * 8/1986 Shaginian ..... E21B 19/20 166/53
4,621,974 A * 11/1986 Krueger ..... E21B 19/20 211/70.4
4,854,400 A 8/1989 Simpson
4,879,802 A 11/1989 Winlker et al.
5,458,454 A * 10/1995 Sorokan ..... E21B 19/155 414/800
6,505,531 B2 1/2003 Stogner
6,821,071 B2 * 11/2004 Woolslayer ..... E21B 19/14 175/85
6,966,385 B2 11/2005 Hemphill et al.
7,036,396 B2 5/2006 Moe et al.
7,178,612 B2 2/2007 Belik
7,249,639 B2 7/2007 Belik
8,464,613 B2 6/2013 Holladay et al.
8,733,472 B2 5/2014 Magnuson
8,899,133 B1 12/2014 Somerville
9,051,782 B2 6/2015 Magnuson
9,097,072 B2 8/2015 Perez
9,354,623 B2 5/2016 Magnuson
9,394,751 B2 7/2016 Magnuson
9,562,407 B2 2/2017 Magnuson
9,643,206 B2 5/2017 Magnuson et al.
9,657,539 B2 5/2017 Gupta et al.
9,695,649 B2 7/2017 Magnuson et al.
9,739,071 B2 8/2017 Deel et al.
9,784,053 B2 10/2017 Magnuson
10,435,964 B2 10/2019 Magnuson et al.
2003/0205112 A1 * 11/2003 Hawkins ..... E21B 19/163 81/57.34
2009/0159294 A1 * 6/2009 Abdollahi ..... E21B 19/14 166/377
2012/0067645 A1 3/2012 Magnuson
2012/0213937 A1 * 8/2012 LaValley ..... B23K 31/027 427/401
2014/0202769 A1 7/2014 Magnuson
2014/0216815 A1 8/2014 Magnuson
2014/0299376 A1 10/2014 Bertelsen
2014/0345858 A1 * 11/2014 Brouwer ..... E21B 19/02 166/255.1
2015/0086718 A1 3/2015 Magnuson et al.
2015/0090463 A1 4/2015 Gupta et al.
2015/0096764 A1 4/2015 Magnuson et al.
2015/0101826 A1 4/2015 Gupta et al.
2015/0232272 A1 8/2015 Magnuson
2015/0330162 A1 11/2015 Magnuson et al.
2016/0060979 A1 3/2016 Magnuson
2016/0060980 A1 3/2016 Magnuson
2016/0076318 A1 * 3/2016 Larkin ..... E21B 19/06 166/75.11
2016/0168928 A1 6/2016 Magnuson
2016/0168929 A1 6/2016 Magnuson et al.
2016/0251869 A1 9/2016 Deel et al.
2016/0319610 A1 11/2016 Magnuson
2016/0376808 A1 12/2016 Magnuson et al.
2017/0096866 A1 4/2017 Magnuson
2017/0167210 A1 6/2017 Magnuson
2017/0209889 A1 7/2017 Magnuson et al.
2017/0254162 A1 9/2017 Magnuson
2017/0268298 A1 9/2017 Magnuson et al.
2018/0245410 A1 * 8/2018 Skjaerseth ..... E21B 19/164

* cited by examiner

SYSTEMS, DEVICES, AND METHODS TO DETECT PIPE WITH A GRIPPERHEAD

PRIORITY DATA

This application claims priority to and the benefit of the filing date of U.S. Provisional Application No. 62/556,802, entitled "Systems. Devices, and Methods to Detect Pipe with a Gripperhead" and filed on Sep. 11, 2017, the disclosure of which is incorporated herein in its entirety.

TECHNICAL FIELD

The present disclosure is directed to systems, devices, and methods for the manipulation, assembly, moving, and detection of tubulars within a derrick or mast in oil and gas drilling systems. More specifically, the present disclosure is directed to systems, devices, and methods for detecting and handling tubulars using a modular gripperhead.

BACKGROUND OF THE DISCLOSURE

The exploration and production of hydrocarbons require the use of numerous types of tubulars also referred to as pipe. Tubulars include but are not limited to drill pipes, casings, and other threadably connectable elements used in well structures. Strings of joined tubulars, or drill strings, are often used to drill a wellbore and, with regards to casing, prevent collapse of the wellbore after drilling. These tubulars are normally assembled in groups of two or more, commonly known as "stands" to be vertically stored in the derrick or mast. The derrick or mast may include a storing structure commonly referred to as a fingerboard. Fingerboards typically include a plurality of vertically elongated support structures or "fingers" each capable of receiving a plurality of "stands."

Rotary drilling and top drive drilling systems often use these stands, instead of single tubulars, to increase efficiency of drilling operations by reducing the amount of connections required to build the drill string in or directly over the wellbore. However, the manipulation of tubulars from a horizontal to a vertical position, assembly of the stands, and presentation of the stands between the fingerboard and the well center are dangerous and can be rather inefficient operations. When the stands are stacked densely in the fingerboard, it is difficult to select, or secure, a stand from the stack of stands using the gripper. Furthermore, existing systems generally do not have the ability to measure the diameter of pipe with the gripper or verify that a pipe is securely grabbed. This can lead to costly errors due to crushed pipes or pipes slipping out of the gripper. Thus, traditional grippers may be improved to better handle pipe.

The present disclosure is directed to pipe gripping systems that overcome one or more of the shortcomings in the prior art.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
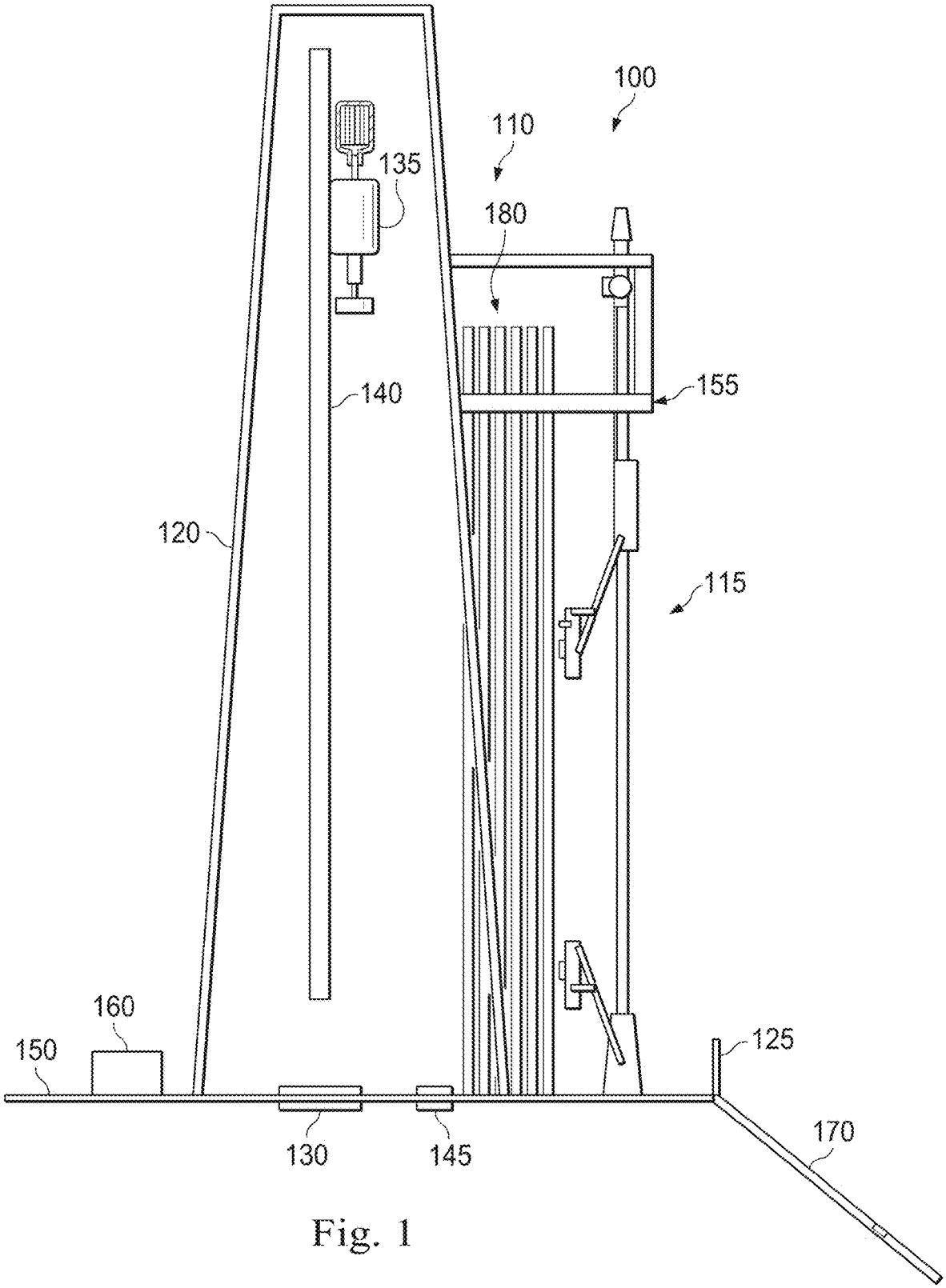
FIG. 1 is a schematic of an exemplary drilling rig according to one or more aspects of the present disclosure.

It is to be understood that the following disclosure provides many different implementations, or examples, for implementing different features of various implementations. Specific examples of components and arrangements are described below to simplify the present disclosure. These are merely examples and are not intended to be limiting. In addition, the present disclosure may repeat reference numerals and/or letters in the various examples. This repetition is for the purpose of simplicity and clarity and does not in itself dictate a relationship between the various implementations and/or configurations discussed. Moreover, the formation of a first feature over or on a second feature in the description that follows may include implementations in which the first and second features are formed in direct contact, and may also include implementations in which additional features may be formed interposing the first and second features, such that the first and second features may not be in direct contact.

The systems, devices, and methods described herein relate to a drilling rig apparatus that includes a modular tubular gripperhead system with an end effector or grabber arm that may include one or more sensors, such as inductive sensors.

In some aspects, the one or more sensors may be used to locate the position of pipes, measure the size of pipes, measure the compression force of the gripperhead, and ensure that pipes are securely gripped by the gripperhead. The gripperhead may connect and disconnect to the remainder of the racker device in a manner that simplifies the changing of the gripperhead to accommodate tubulars or casing having different external diameters. The modules may be moved as a part of the drilling rig apparatus from one drilling location to another drilling location, or may be moved from one drilling rig apparatus to a separate other drilling rig apparatus. Since the gripperhead system comprises modules, the setup and tear down may be accomplished in a minimal amount of time, decreasing down time required between moves. In addition, because the gripperhead system is modular, one module may replace a worn or unusable module in a minimal amount of time. This may reduce the amount of time required for repairs and, likewise, may increase productivity.

This disclosure discusses components that are permanently fixed together to form a module of the gripperhead system. As used herein, the term "permanently fixed" means that the components are mechanically fixed or maintained together as an assembly and are intended to stay fixed or maintained together during connection or disconnection with the remainder of a racker device and stay fixed or maintained together during operation of the gripperhead system or drilling rig. The components may be in either direct contact or indirect contact. The term "permanently fixed" does not mean that the components are unable to be disassembled for other purposes such as repair of worn or broken elements, for permanent takedown, cleaning, refurbishing, recycling, or other purposes.

FIG. 1 is a schematic of a side view an exemplary drilling rig apparatus 100 according to one or more aspects of the present disclosure. In some examples, the drilling rig apparatus 100 may form a part of a land-based, mobile drilling rig. The drilling rig apparatus 100 may have a drill floor size of about 35×35 feet, although larger and smaller rigs are contemplated. In some implementations, the drilling rig apparatus 100 may have a drill floor size of less than approximately 1,540 square feet. In other implementations, the drilling rig apparatus 100 may have a drill floor size of less than approximately 1.720 square feet.

The drilling rig apparatus 100 shown in FIG. 1 includes rig-based structures 110 and a modular racker system 115 that operates on the rig-based structures 110. The rig-based structures 110 include, for example, a foundational chassis or rig frame (not shown), a mast 120, and a v-door 125 into the drilling rig apparatus 100. The v-door 125 may be arranged to receive tubulars or stands introduced to the drilling rig apparatus 100. In an implementation, the mast 120 is disposed over and about a well-center 130 and supports a plurality of drilling components of a drilling system, shown here as a top drive 135 and its components disposed and moveable along a support column 140. Other drilling components are also contemplated.

This implementation includes an offline mouse hole 145 that may be used to assemble tubulars into stands at a location spaced apart from the well-center 130 so as to not interfere with drilling at the well-center 130. In some implementations, the mouse hole 145 is located above a shallow hole below a rig floor 150 that is offline from the well-center 130, where individual tubulars may be assembled together into stands, e.g. a plurality, such as three tubulars together that are then racked in a fingerboard 155 for later use or storage. The racker system 115 is described in greater detail below.

A rig control system 160 may control the racker system 115 and other rig components, while also communicating with sensors disposed about the drilling rig apparatus 100. As described below, the sensors may include inductive sensors disposed on manipulator devices, such as grabbers and grippers. The rig control system 160 may evaluate data from the sensors, determine the position and size of tubulars, evaluate the state of wear of individual tubulars or stands, and may make recommendations regarding validation of tubulars for a particular use as a part of a drilling operation, and perform other tasks. In some implementations, the rig control system 160 may be disposed on the drilling rig apparatus 100, such as in a driller's cabin, may be disposed in a control truck off the drilling rig apparatus 100, or may be disposed elsewhere about the drilling site. In some implementations, the rig control system 160 is disposed remote from the drilling site, such as in a central drill monitoring facility remote from the drill site.

A catwalk 170 forms a part of the drilling rig apparatus 100 and may be directly attached to or disposed adjacent the rig floor 150. The catwalk 170 allows the introduction of drilling equipment, and in particular tubulars or stands, to the v-door 125 of the drilling rig apparatus 100. In some implementations, the catwalk 170 is a simple, solid ramp along which tubulars may be pushed or pulled until the tubular can be grasped or secured by the racker system 115. In other implementations, the catwalk 170 is formed with a conveyer structure, such as a belt-driven conveyer that helps advance the tubulars toward or away from the drilling rig apparatus 100. Other implementations include friction reducing elements, such as rollers, bearings, or other structures that enable the tubulars to advance along the catwalk toward or away from the v-door 125. It should be noted that land rigs may utilize catwalks while offshore rigs may utilize conveyors to transport tubulars from the pipe deck to the rig floor 150. Therefore, it should be understood that description herein of components used as a part of a land rig may also be utilized in an offshore rig.

Figure 2:
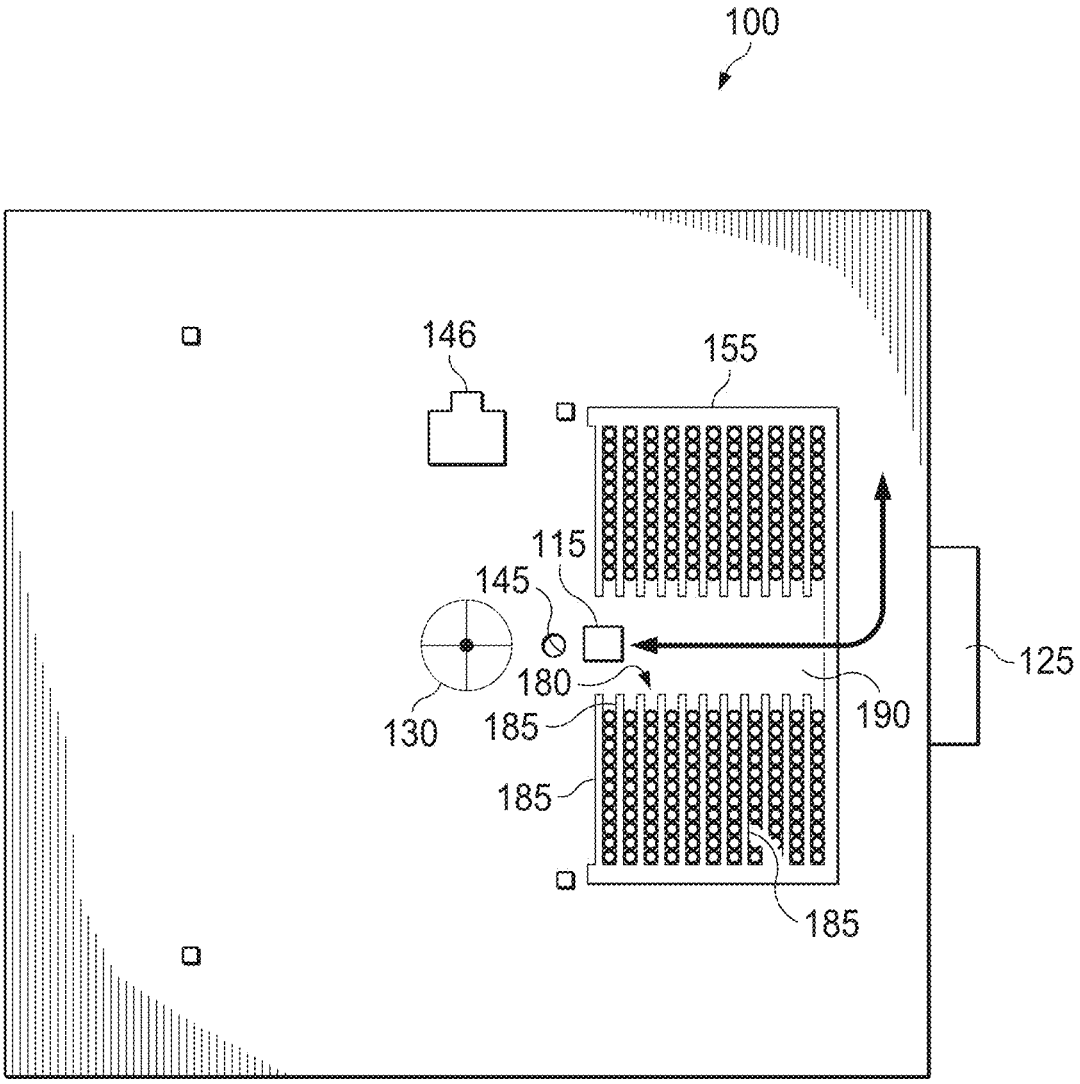
FIG. 2 is a schematic top view of an exemplary drilling rig according to one or more aspects of the present disclosure.

FIG. 2 is a schematic of a top view of the exemplary drilling rig apparatus 100 according to one or more aspects of the present disclosure. FIG. 2 illustrates the fingerboard 155 and other portions of the racker system 115, the stands 180, fingers 185 forming a part of the fingerboard 155, an iron roughneck 146, the mouse hole 145, and the well-center 130, all as generally described above. The iron roughneck 146 may be moved about the drilling rig and may be used to connect and disconnect tubulars or stands at either or both of the well-center 130 and the mouse hole 145. A passageway 190 may extend between opposing sides of the fingerboard 155 between the v-door 125 and the well-center 130. The racker system 115 may travel along the passageway 190 indicated by the arrow in FIG. 2 to manipulate tubulars or stands between the fingerboard 155, the mouse hole 145, the well-center 130, and the v-door 125, and it may travel laterally to a position, such as a parking position, out of the passageway and out of the pathway between well-center 130 and the v-door 125.

Figure 3:
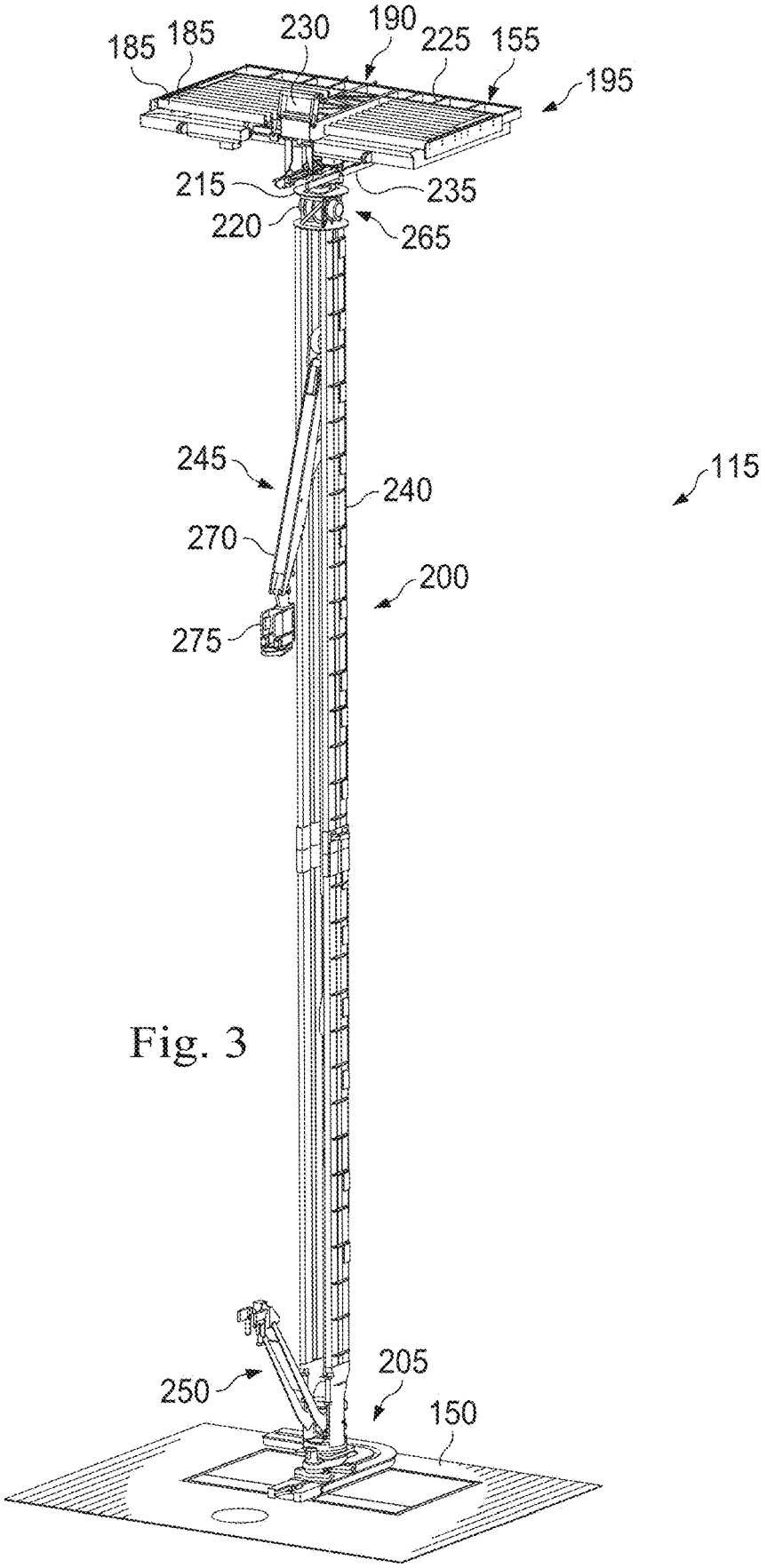
FIG. 3 a schematic of a perspective view of an exemplary racker system according to one or more aspects of the present disclosure, the racker system including a gripperhead.

FIG. 3 shows the racker system 115 in greater detail. It includes an upper track module 195, a racker column module 200, and a lower track module 205. In FIG. 3, the upper track module 195, the racker column module 200, and the lower track module 205 are shown connected in place.

The modules may be separated from one another for transport to a new location while still substantially maintaining their own respective assembled states. In some implementations, however, the modules may still require some level of packing or unpacking, such as folding or collapsing to a more compact state for transport, and unfolding or extending for reuse. Because of this, the modules may also be easily and quickly interchanged with other similar modules, such as by including quick release components to attach and retain modules to each other, and quick connectors to permit simple "plug n' play" with electrical and hydraulic connectors. This may help expedite repairs, because a replacement module may be introduced in place of an older worn or broken module, and the worn or broken module may be removed and entirely fixed offline while the new module is used to keep the racker system 115 and the drilling rig apparatus 100 in operation. In another implementation, the replacement module is swapped in during transport of the modules from one rig or rig site to another.

The upper track module 195 includes, for example, the fingerboard 155, upper rails 235, a rotational union 215 for the column structure, and a festoon system 220.

The fingerboard 155 is a holding or storage area for stands that have been or will be used to build the drill string. These stands may be stored in the fingerboard 155 until they are used or broken down for removal from the drilling rig apparatus 100. The fingerboard 155 includes an outer support frame 225 having a plurality of individual fingers 185 extending in a parallel direction and cantilevered from the support frame 225. The upper portions of the stands may be inserted between the fingers 185 and thereby held in place, in a substantially vertical position for storage. As can be seen, in this implementation, the fingerboard 155 includes a left side and a right side, with the passageway 190 therebetween. A support structure 230 extends from the support frame 225 along the passageway 190 and supports upper rails 235. In some implementations, the fingerboard 155 of the upper track module 195 is arranged and configured to attach to and be supported by the mast 120 (as shown in FIG. 1). In some examples, it is cantilevered from the mast and extends over a portion of the rig floor 105. Other implementations include a support structure, such as a derrick that supports the fingerboard 155 and the upper track module 195.

The upper rails 235 are, in this exemplary implementation, suspended from the support structure 230 of the fingerboard 155 and form an upper track for an upper cart housing. The upper rails 235 are permanently fixed to the fingerboard 155, and therefore are not disconnected from the fingerboard 155 during rig assembly, disassembly, or during transport. Accordingly, when the fingerboard 155 is attached to the mast 120, there is little or no additional work or effort required to assemble and attach the upper rails 235. The upper rails 235 extend along the passageway 190 between opposing sides of the fingerboard between the v-door 125 and the well-center 130 (as shown in FIGS. 1 and 2). In the implementation shown, the upper rails 235 curve or extend to a position outside the passageway 190 so that the upper cart housing can travel to a position that may be used to park the racker column module 200 to the side of the passageway 190 between the v-door 125 and the well-center 130. Accordingly, the upper rails 235 in this implementation form an L-shape. Here, there are two upper rails 235, however, other implementations include additional or fewer rails, or include other structures such as the upper track.

The upper track module 195 is configured to move the upper portion of the racker column module 200 along the upper rails 235. The upper track module 195 may include rollers, sliding pads, or other structures that facilitate movement of the racker column module 200 between the v-door 125, the mouse hole 145, and the well-center 130 below the mast 120.

The racker column module 200, includes a column 240, a middle arm assembly 245, a lower arm assembly 250, a housing (not labeled), and a motor and braking system (not labeled). The racker column module 200 extends between and connects with the upper track module 195 and the lower track module 205.

The column 240 of the racker column module 200 provides rigidity and support to the racker system 115, provides structural support of the middle and lower arm assemblies 245, 250, and connects the upper track module 195 to the lower track module 205. The column 240 may be formed of a single solid beam or a plurality of beams joined together end to end. In some implementations, the column 240 includes two parallel plates, spaced apart to hold the middle and lower arm assemblies 245, 250 therebetween.

In this example, a hoisting system 265 is disposed at the top end of the column 240 and receives electric or hydraulic operating power from cables or hoses carried on the upper track module 195. The hoisting system 265 may include a cable extending to the middle arm assembly 245 and may be used to raise and lower the middle arm assembly 245 along the column 240.

The middle arm assembly 245 slides vertically along the support column 140 and may be extended or manipulated to grasp the upper end of tubulars, carry, move or otherwise displace a tubular/stand. In some implementations, the middle arm assembly 245 may move upward or downward on rollers, slide pads, or other elements disposed on the column 240 or carried on the middle arm assembly. The lower arm assembly 250 is, in the exemplary implementation shown, pivotably attached in place on the lower portion of the column 240.

The middle arm assembly 245 and the lower arm assembly 250 are configured to reach out to insert a drill pipe stand into or remove a drill pipe stand from the fingerboard 155. That is, they extend outwardly from the column 240 to clamp onto or otherwise secure a drill pipe stand that is in the fingerboard 155 or to place a drill pipe stand in the fingerboard 155. In addition, the middle arm assembly 245 and the lower arm assembly 250 are configured to reach out to receive tubulars introduced to the drilling rig apparatus 100 through the v-door 125 and to carry tubulars or stands from the v-door 125 or the fingerboard 155 to the mouse hole 145 or to the well-center 130 for hand-off to the drilling elements, such as the top drive 135. As indicated above, the middle arm assembly 245 may move vertically up and down along the column 240. In some aspects, it is operated by the hoisting system 265.

The middle arm assembly 245, which may be considered part of the gripperhead system, includes a manipulator interface or manipulator holder assembly 270 and a gripperhead 275. Generally, the gripperhead 275 is sized and shaped to open and close and to grasp or retain tubing, such as tubulars or stands. The manipulator holder assembly 270 may move the gripperhead 275 toward and away from the column 240.

Figure 4:
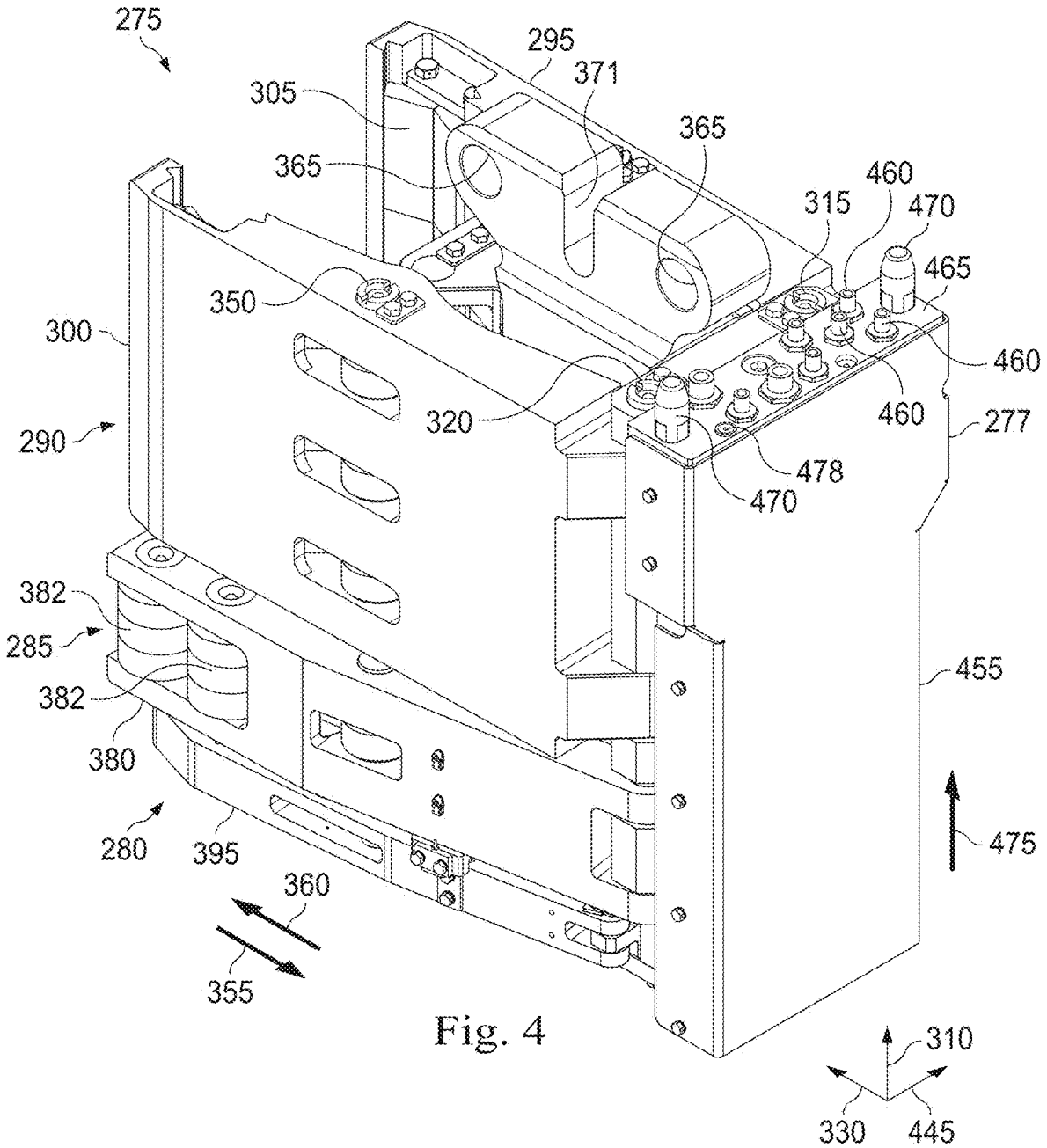
FIG. 4 is a perspective view of the gripperhead of FIG. 3 according to one or more aspects of the present disclosure.
Figure 5:
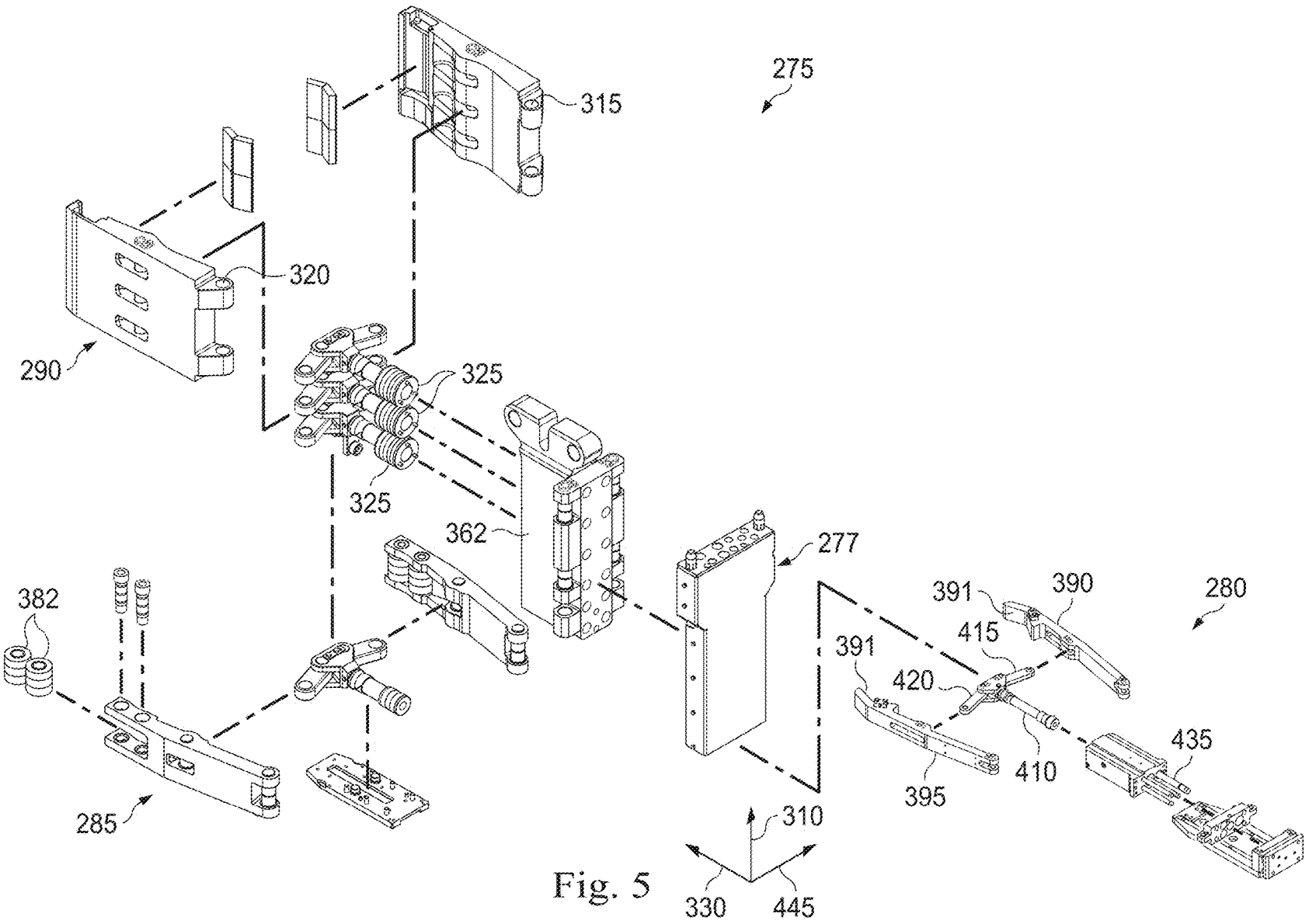
FIG. 5 is a perspective, exploded view of the gripperhead of FIG. 4 according to one or more aspects of the present disclosure.

FIGS. 4-5 show the gripperhead 275 in greater detail. Generally, the gripperhead 275 is an articulated system that includes a number of manipulators including a grabber 280, a centralizer 285, and a gripper 290. The effector, or grabber 280 may be configured to select, secure, and pull a tubular towards the gripperhead 275. The gripperhead 275 also includes a centralizer 285 that centralizes the tubular secured by the grabber 280. The gripperhead 275 also includes a gripper 290 that also secures the tubular for movement of the tubular. The gripperhead 275 also includes a hydraulic manifold assembly 277 that is fluidically and/or electrically coupled to each of the grabber 280, the centralizer 285, and the gripper 290.

Figure 6:
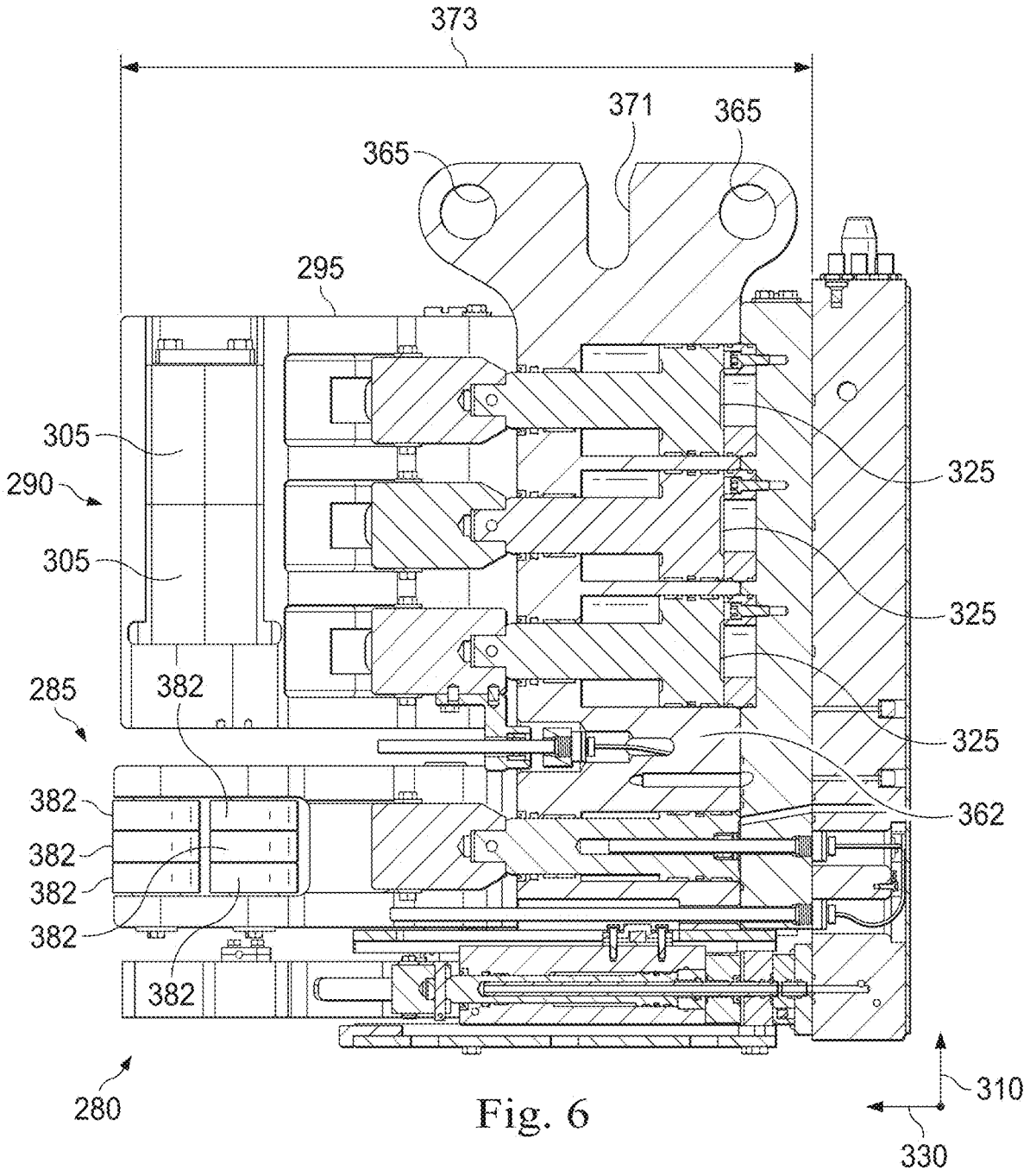
FIG. 6 is a sectional, perspective view of the gripperhead of FIG. 3 according to one or more aspects of the present disclosure.
Figure 7:
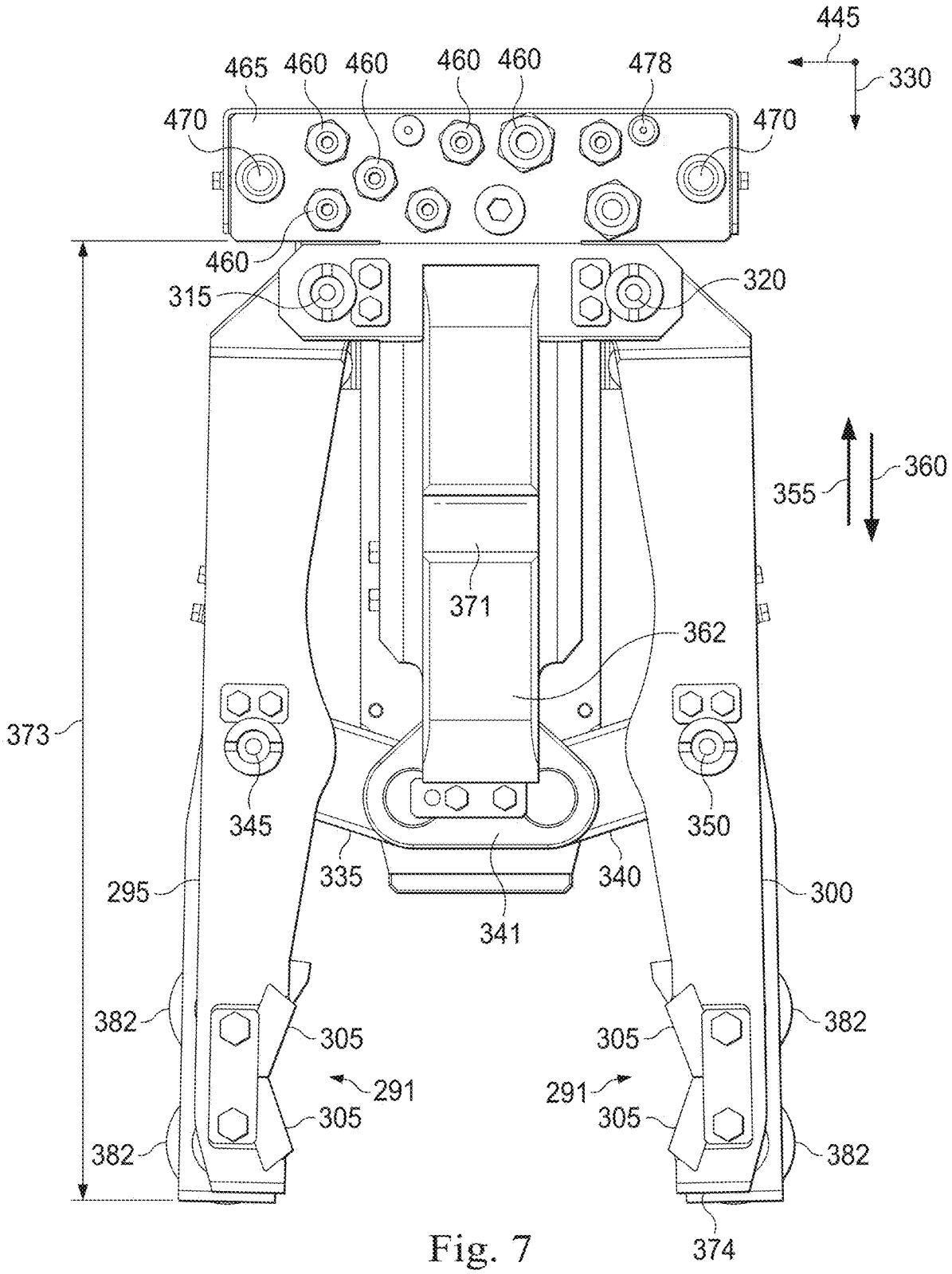
FIG. 7 is a top view of the gripperhead of FIG. 3 according to one or more aspects of the present disclosure.

As shown in FIGS. 4 and 6-7, the gripper 290 includes a first gripper arm 295 and a second opposing gripper arm 300. Each of the gripper arms 295 and 300 includes an inwardly facing gripping surface 291. The inwardly facing gripping surfaces 291 may include a plurality of v-shaped dies 305 that are coupled to an inward surface of the gripper arms 295 and 300 (i.e., the surface of the gripper arms 295 and 300 that faces the other) along an axis parallel to and represented by the arrow having the numeral 310 in FIG. 4 ("axis 310"). Each of the gripper arms 295 and 300 pivot about a pivot point 315 and 320, respectively. When pivoting about the pivot points 315 and 320, the gripper arms 295 and 300 move between an open position and a closed position. The gripper 290 may also include one or more locking arms which may be configured to retain a tubular within the gripper arms 295 and 300. The locking arms may be attached to an end of the gripper arms 295 and 300 and rotate between a locked position when a longitudinal axis of each locking arm is in a generally horizontal position and an open position when the longitudinal axis of each locking arm is in a generally vertical position. The locking arms may be hydraulically driven to the open position and spring driven back to a closed position. The gripper 290 also includes a plurality of hydraulically actuated pistons 325, with each piston extending along an axis parallel to and represented by the arrow having the numeral 330 in FIG. 4 ("axis 330"). In this exemplary implementation, two pivotable arms 335 and 340 are coupled to a link 341 disposed at one end of each piston 325 and are coupled to either the first gripper arm 295 (about pivot point 345) or the second gripper arm 300 (about pivot point 350). Thus, the arms 295 and 300 are pushed apart when the plurality of hydraulically actuated pistons 325 retract in a first direction 355 along the axis 310 and are pulled together when the plurality of pistons 325 extend, or stroke out, in a second direction 360 that is opposite from the first direction 355. The pistons 325 extend through a generally longitudinally extending body 362 (extending in the axis 330).

An upper portion of the body 362 forms two bores 365 and a longitudinally extending slit 371 (extending in the axis 330) sized to receive a corresponding portion of the manipulator holder assembly 270. The manipulator holder assembly 270 may include two corresponding bores 551 to the bores 365 (as shown in FIG. 12). A pin may extend through each of the bores 365 and the bores 551 in the manipulator holder assembly 270 when the manipulator holder assembly 270 is secured to the gripperhead 275. Generally, the gripper 290 closes to apply a sufficient force to the tubular accommodated within the gripper arms 295 and 300 so that the gripperhead 275 can hoist and otherwise manipulate the tubular, whether horizontal to vertical or vertical to horizontal manipulation. The gripper 290 has a dimension 373 defined in the direction of the axis 330. The dimension 373 is defined by a front-most surface 374 of the gripper 290 in the second direction 360 and a back-most surface in the first direction 355. Generally, the inwardly facing gripping surfaces form at least a portion of a generally cylindrical chamber having a longitudinal axis that is parallel or concentric to the axis 310. In some implementations, such as the examples shown in FIGS. 10-12, the grabber 280, centralizer 285, gripper 290, and manipulator holder assembly 270 include sensors to locate the position of tubulars, measure tubular size, measure the compression force of the grabber 280, centralizer 285, and gripper 290 on tubulars to avoid crushing the tubulars, and ensure that tubulars are securely gripped. These sensors may include proximity, inductive, and ultrasonic type sensors.

Figure 8:
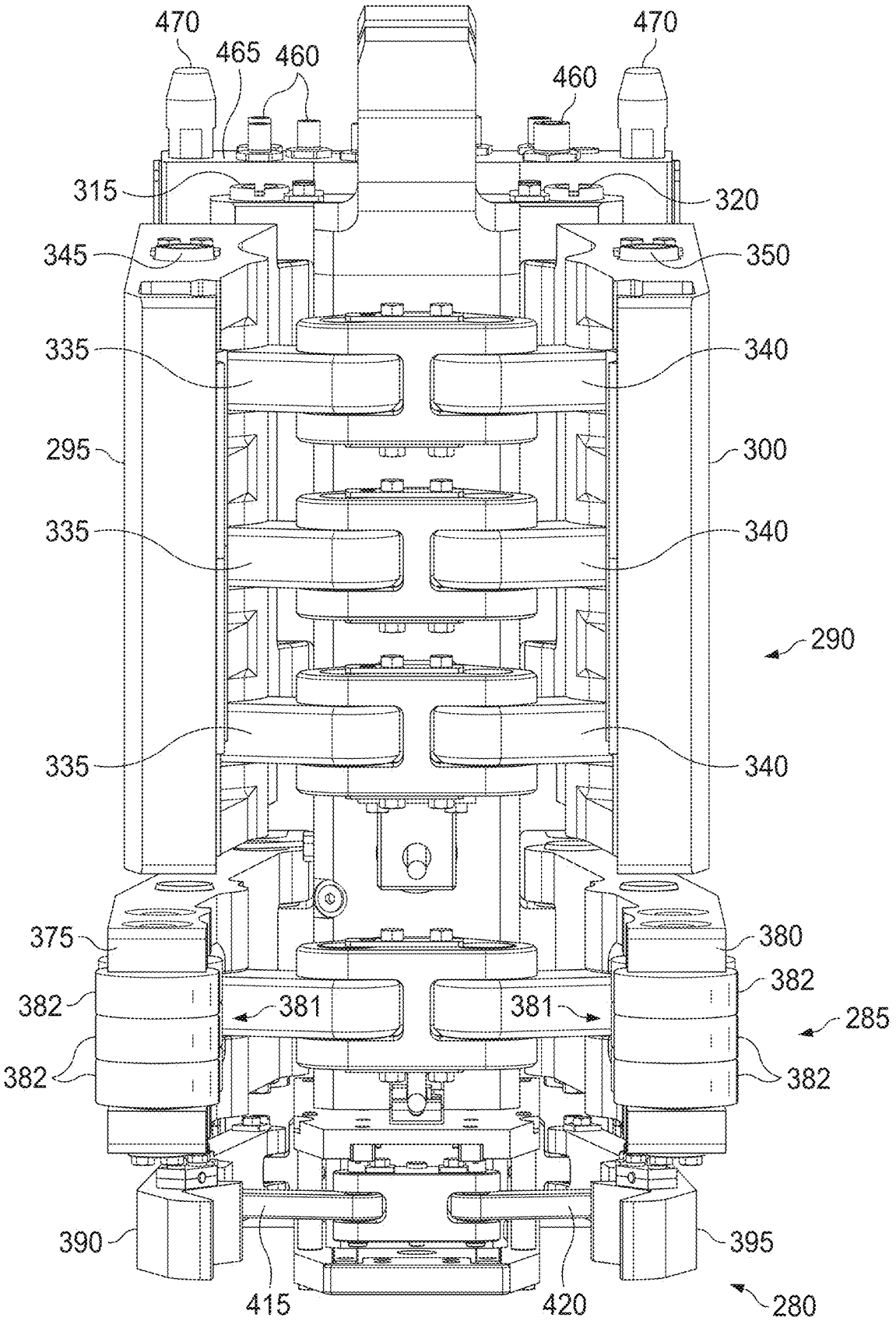
FIG. 8 is another perspective view of the gripperhead of FIG. 4 according to one or more aspects of the present disclosure.
Figure 9:
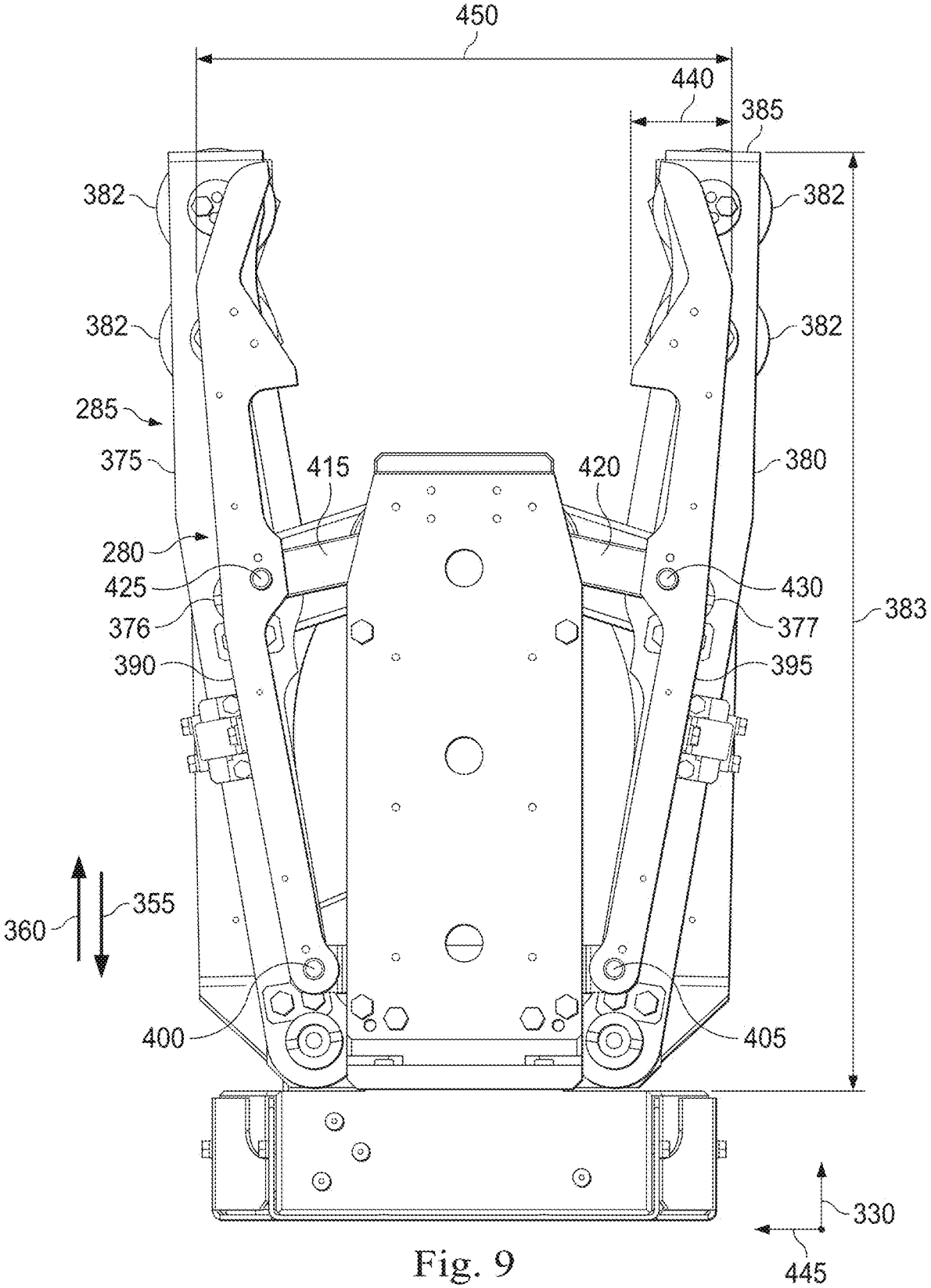
FIG. 9 is a bottom view of the gripperhead of FIG. 4 according to one or more aspects of the present disclosure.

As shown in FIGS. 8-9, the centralizer 285 may include a first centering arm 375 and an opposing second centering arm 380. Each of the centering arms 375 and 380 includes an inwardly facing gripping surface 381. The inwardly facing gripping surfaces 381 may include a plurality of rollers 382 spaced along the axes 330 and axis 310. The first and second arms 375 and 380 are movable between a "closed" and "open" position in a similar manner to the arms 295 and 300. That is, the first and second arms 375 and 380 are also pivotable about the pivot points 315 and 320, respectively. The first and second arms 375 and 380 are also movable due to a piston that is coupled to two pivotable arms 335 and 340 (as shown in FIG. 7), with one arm 335 pivotable about the pivot point 345 and the other arm 340 pivotable about the pivot point 350. Generally, the centralizer closes to grip the tubular and centralize the tubular. The centralizer 285 also allows for the rotation of the tubular within the centralizer 285 when the centralizer 285 is in a closed position. The centralizer 285 defines a dimension 383 defined in the axis 330. The dimension 383 is at least in part defined by a front-most surface 385 of the centralizer 285 in the second direction 360 and a back-most surface in the first direction 355.

Figure 5A:
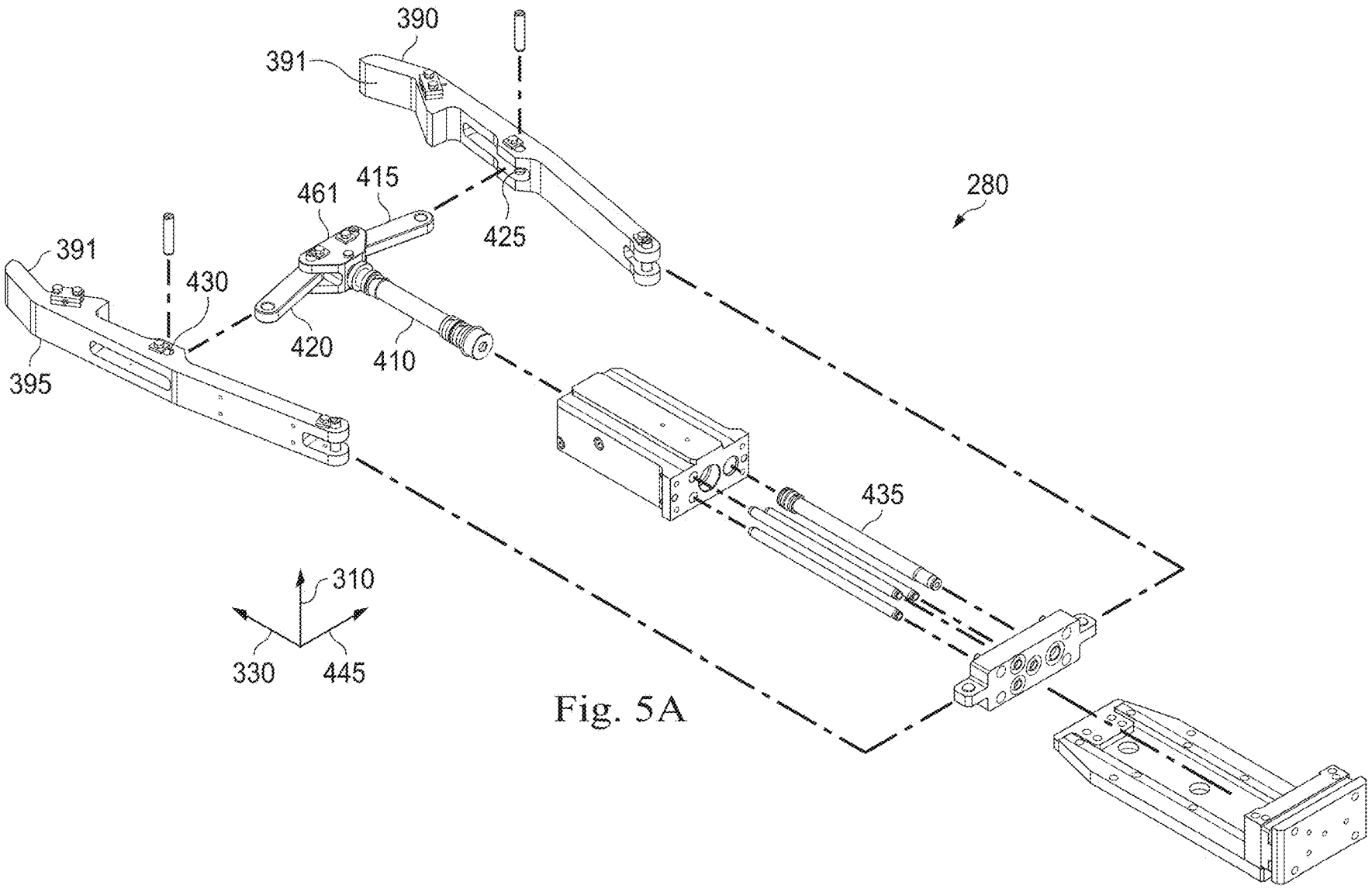
FIG. 5A is an enlarged portion of the exploded view of FIG. 5, according to one or more aspects of the present disclosure.

The grabber 280 may include a first grabber arm 390 and a second opposing grabber arm 395. Each of the grabber arms 390 and 395 includes an inwardly facing gripping surface 391. The inwardly facing gripping surfaces 391 may be a concave or generally v-shaped surface. Each of the grabber arms 390 and 395 pivot about a pivot point 400 and 405, respectively. When pivoting about the pivot points 400 and 405, the grabber arms 390 and 395 move between an open position that may allow a tubular to enter or be removed from the chamber and a closed position that may secure the tubular in the gripperhead. Similar to the centralizer 285, the grabber 280 includes a hydraulically actuated piston 410 (as shown in FIGS. 5 and 5A) with a link 416 to which two pivotable arms 415 and 420 are pivotably coupled. The grabber 280 also includes a piston 435 which may extend, or move, in a direction along the axis 330. The arm 415 is coupled to the arm 390 at a pivot point 425 (such as by a cylindrical connector or pivot 376) and the arm 420 is coupled to the arm 395 at a pivot point 430 (such as by a cylindrical connector or pivot 377). Also similar to the centralizer 285 and the gripper 290, closing the grabber arms 390 and 395 secures the tubular within the grabber 280. The arms 390 and 395 extend in the direction 360 such that at least a portion of the arms 295 and 300 extend beyond, in the direction 360, the front-most surface 385 of the centralizer 285, the front-most surface 374 of the gripper 290, or both. Thus, the grabber 280 is configured to extend beyond the gripper 290 and the centralizer 285. Generally, the portion of the arms 295 and 300 that extend beyond the front-most surfaces and 385 and 374 has a width 440 that is measured approximately along an axis represented by the arrow having the numeral 445. Generally, the width 440 of each arm 390 and 395 may be approximately 1.5 inches, may be approximately 1.25 inches, 1.1 inches, or 1 inch. In an exemplary implementation, the width 440 of each arm 390, 395 is dependent upon the dimensions of the fingers 185 such that the each arm 390, 395 is sized to extend between rows of racked stands. The width 440 of each arm 390, 395 may be any dimension in the range between about 2 inches and about 0.5 inches. In other implementations, the width 440 of each arm 390, 395 may be greater than 2 inches. In an exemplary implementation, the width 440 of each arm 390, 395 is sized to be the same as or less than the width of a finger 185. Generally, each of the gripper arms 295 and 300 and each of the centering arms 375 and 380 defines a width greater than the width 440.

Using the middle arm assembly 245 allows the grabber arms 390 and 395 to select and grab a tubular or stand in a pack of tightly backed tubulars or stands when the width of the gripper arms 295 and 300 and the width of the centering arms 375 and 380 are too large to extend between tubulars that are densely racked. Thus, the middle arm assembly 245 allows the grabber arms 390 and 395 to extend between tubulars that are densely racked, which is the traditional method of racking in modular land rigs to minimize space utilization. Moreover, the grabber arms 390 and 395 together may define a dimension 450 along the same axis as the width 440. In one exemplary implementation, and when in the open position, the dimension 450 is less than the total width of two fingers 185 and a spacing formed between two consecutively spaced fingers 185. A hydraulically actuated piston 435 (FIG. 5) pushes the arms 390 and 395 in the direction 360 and retracts the arms 390 and 395 in the direction 355. In the retracted position, and as shown in FIG. 9, the grabber arms 390 and 395 are not extending beyond the front-most surfaces 385 and 374.

Referring back to FIG. 4, the hydraulic manifold assembly 277 includes a body 455 having a generally rectangular box-like shape. However, the body 455 may form any shape. The hydraulic manifold assembly 277 includes a plurality of hydraulic "quick connect" ports 460 on a top surface 465 of the body 455. Generally, the number of ports 460 is dependent upon the number of hydraulically actuated pistons within the gripperhead 275. Referring back to FIGS. 4, 5, and 7, eight ports 460 extend from the body 455 in a direction represented by the arrow having the numeral 475 in FIG. 4 ("the direction 475"). The number of ports 460 depends upon the design and functionality of the gripperhead 275. In the exemplary implementation described, two ports provide hydraulic fluid flow for the centralizer 285, two ports provide hydraulic fluid flow for the gripper 290, and four ports provide hydraulic fluid flow for the grabber 280. In this implementation, because the grabber 280 both opens and closes and extends and retracts, it uses additional hydraulics. Other implementations may have other arrangements. The hydraulic manifold assembly 277 may also include one or more electrical quick connects on the top surface 465, with the electrical quick connects configured to mate with a corresponding electrical connection on the manipulator holder assembly 270. One or more guides 470 also extend from the body 455 in the direction 475. Generally, the guides 470 are sized to corresponding with mating bores 553 in the manipulator holder assembly 270 (as shown in FIG. 12). Together, the slit 371 and guides 470 are self-guiding couplers in that when the slit 371 receives the corresponding portion of the manipulator holder assembly 270 and the guides 470 are received in corresponding mating bores of the manipulator holder assembly 270, each of the hydraulic ports 460 is aligned with a corresponding hydraulic connector/port located on the manipulator holder assembly 270. Alignment of the bores 365 with the corresponding bores on the manipulator holder assembly 270 results in fluidically coupling the ports 460 with the corresponding hydraulic connector located on the manipulator holder assembly 270 and electrically coupling the manipulator holder assembly 270 with the gripperhead 275. Removal of the pins or other fasteners from bores 365 of the body 362 will release the manipulator holder assembly 270 from the gripperhead 275 and, due to the quick connect hydraulic connectors, each of the hydraulic ports 460 is simultaneously or near simultaneously disconnected from the corresponding hydraulic connectors on the manipulator holder assembly 270. Moreover, the manipulator holder assembly 270 is electrically decoupled from the gripperhead 275 simultaneously or near simultaneously to the hydraulic decoupling of the gripperhead 275 from the manipulator holder assembly 270. In an exemplary implementation, the hydraulic manifold assembly 277 may also include a proximity sensor 478 located on the top surface 465 (or elsewhere) such that the manipulator holder assembly 270 can "read" or otherwise determine, based on the sensor 478, information regarding the gripperhead 275, such as the range of outer diameters for which the gripperhead 275 can accommodate. In some implementations, the grabber arms 390 and 395 include tapered leading tips that may be tapered to better penetrate spaces between adjacent tubulars. This may allow the grabber arms 390 and 395 to more easily grasp tubulars in the fingerboard 155.

Figure 10:
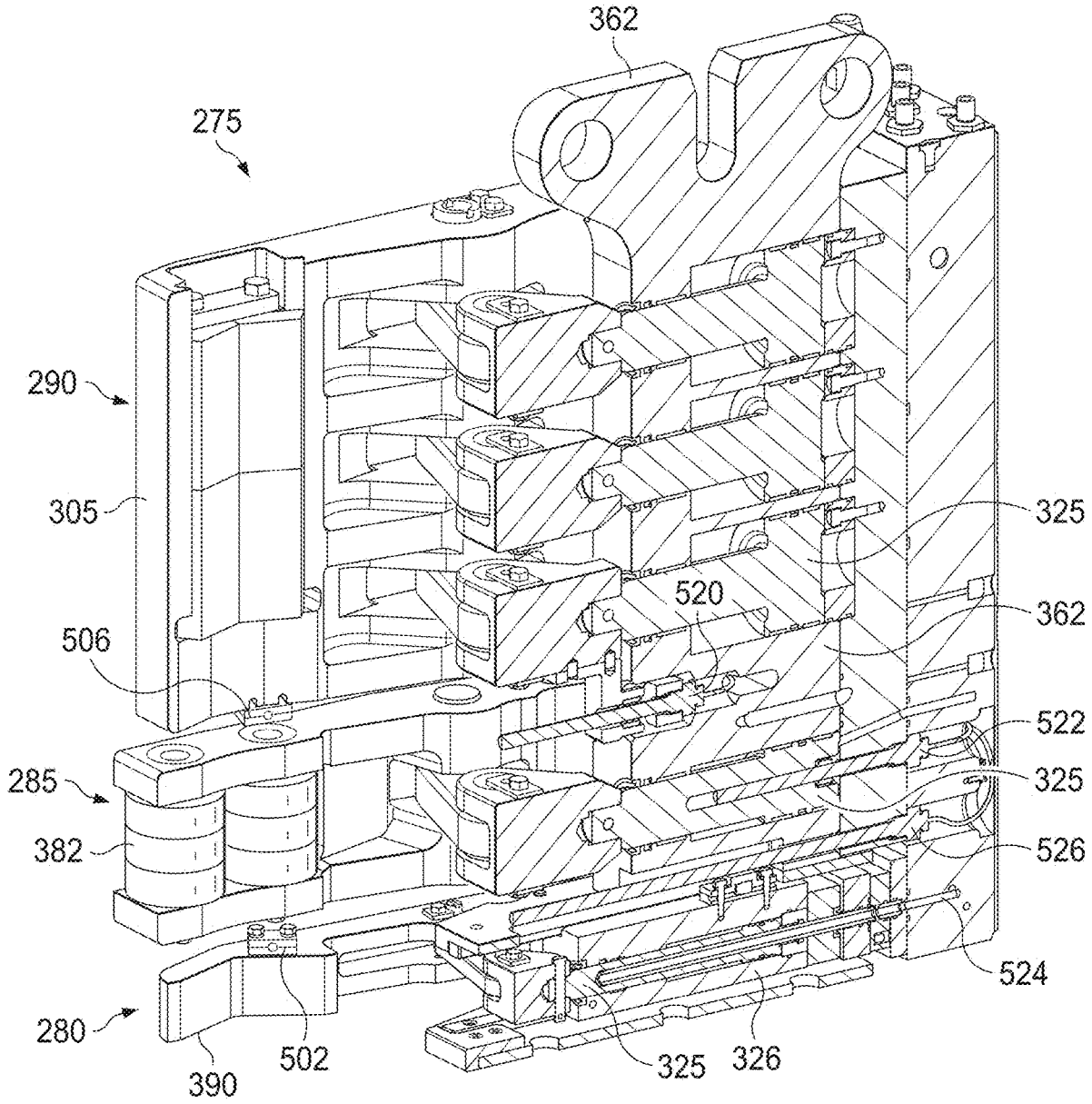
FIG. 10 is a sectional, perspective view of a gripperhead including one or more sensors according to one or more aspects of the present disclosure.
Figure 11:
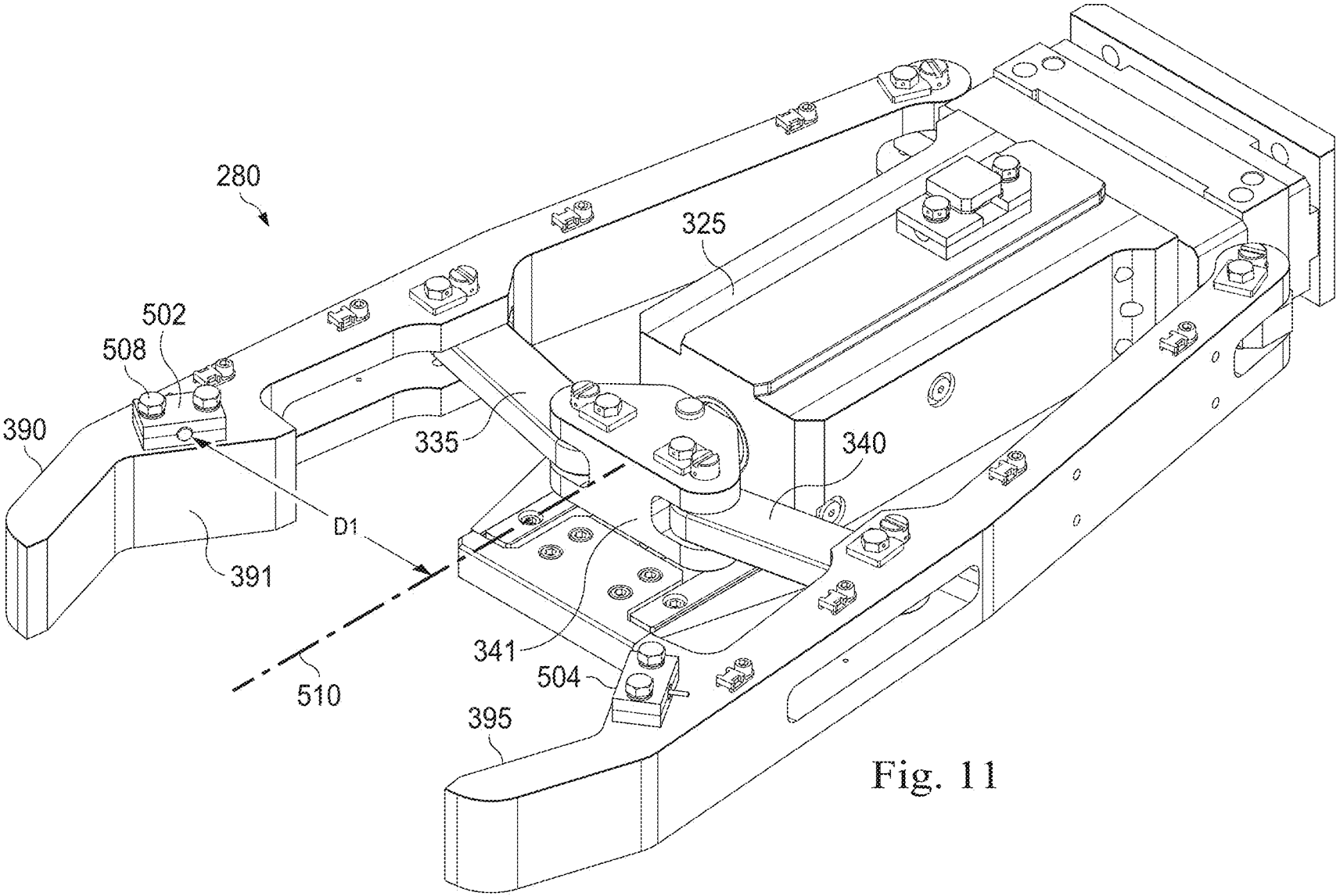
FIG. 11 is a perspective view of a gripperhead of including one or more sensors according to one or more aspects of the present disclosure.
Figure 12:
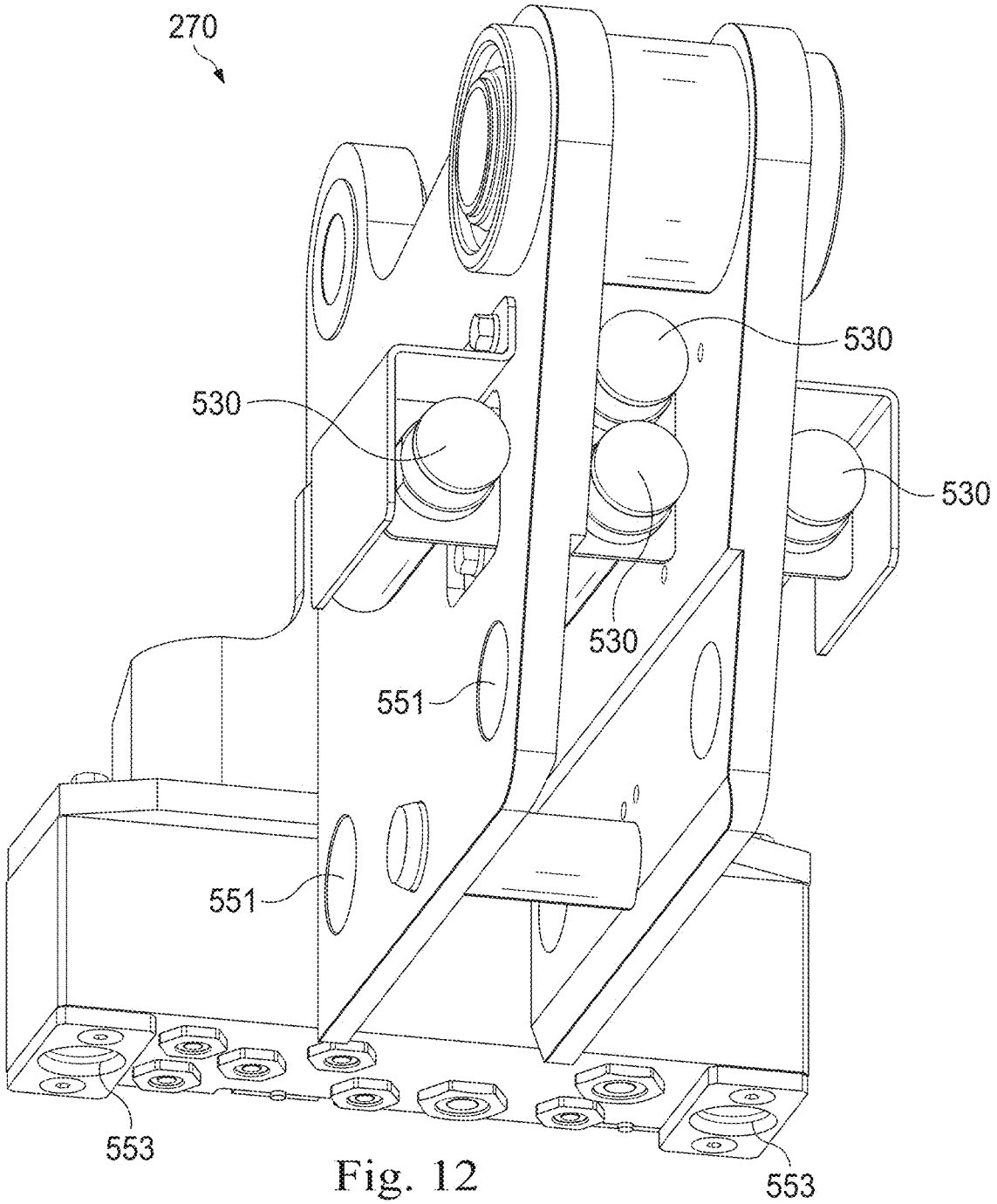
FIG. 12 is a perspective view of a manipulator holder assembly including one or more sensors according to one or more aspects of the present disclosure.

Referring to FIGS. 10-12, one or more sensors 502, 504, 506, 520, 522, 524, 530 may be placed on various parts of the gripperhead 275 and manipulator holder assembly 270. These sensors 502, 504, 506, 520, 522, 524, 530 may be configured to make measurements that may enable detection of and/or gather information that can be used to determine information relating to tubulars carried by the gripperhead 275.

Referring to FIG. 10, a sectional perspective view of a gripperhead 275 is shown including a grabber 280, a gripper 290, and a centralizer 285. The gripperhead 275 may include one or more sensors 502, 506, 520, 522, 524 that may be disposed on the gripperhead 275 in various locations, such as on or more arms of the grabbers 280 and/or gripper 290 (such as sensors 502 and 506), within the pistons 325 (such as sensors 522 and 524), or between the pistons (such as sensor 520), as shown in the example of FIG. 10. Sensors such as sensor 526 may also be positioned within the gripperhead 275 and connecting devices. Other sensors may also be positioned on the manipulator holder assembly 270, which may positioned above the gripperhead 275 and shown in FIG. 12. The one or more sensors 502, 506, 520, 522, 524 may be configured to directly detect or gather information usable to determine the position of tubulars (such as the where the tubular is located between the arms of the grabber 280 and/or gripper 290), measure tubular size, validate the compression force of the arms of the grabber 280 and/or gripper 290, and ensure that the tubular is securely gripped by the grabber 280 and/or gripper 290.

The one or more sensors 502, 506, 520, 522, 524, 526 may include sensors of different types, such as inductive sensors, proximity sensors, and/or ultrasonic sensors. In some implementations, sensors 502 and 506 are proximity sensors, sensors 520, 522, and 524 are inductive sensors, and other sensors 530 (as shown in FIG. 12) disposed on the manipulator holder assembly 270 are ultrasonic sensors. In particular, sensors 502, 504 (FIG. 11), 506 may be proximity sensors configured to sense nearby ferrous objects. Sensors 520, 522, 524 may be linear variable differential transducers (LVDTs). These sensors 502, 506, 520, 522, 524, 530 may be used as a group to determine the position and size of a tubular and determine that it is securely gripped without being overly deformed.

As indicated previously, the one or more sensors 502, 504, 506, 520, 522, 524, 530 may be in communication with one or more controllers including, for example, the rig control system 160. The rig control system 160 may receive information or data from any of the sensors described herein and use that information to determine the position of tubulars, measure tubular size, validate compression forces, and ensure that a tubular is securely gripped by the gripperhead 275.

In some implementations, the sensors 520, 522, 524, may be configured to take measurements indicative of the distance between the arms of the grabber 280, gripper, 290, or centralizer 285. For example, sensor 522 may be disposed within a housing 326 that is connected to arms 390, 395 of the grabber 280. The sensor 522 may include an inductive sensor portion as well as a movable magnetic device. In some implementations, the sensor 522 is connected to a piston 325 within the housing 326. The sensor 522 may be configured to measure the distance that the piston 325 moves as the arms 390, 395 are actuated. In some implementations, this distance is measured in reference to a center line, as shown by distance D1 to center line 510 in FIG. 11. The center line 510 may be established based on the geometry of the grabber 280, gripper 290, and/or centralizer 285 as well as the position and range of pistons. The sensor 260 may be connected to a controller, such as the rig control system 160 as shown in reference to FIG. 1, and may send measurements to the controller for analysis. The controller may correlate the measurements of the movement of the piston to a distance between the arms 390, 395. Similar measurements may be received by sensor 524 disposed within other pistons and sensor 520 disposed in a rear portion of the centralizer 285. In some implementations, data from two or more sensors may be compared to produce more accurate measurements. For example, sensors 520 and 522 are both disposed in different portions of the centralizer 285. The measurements of these sensors 520, 522 may be compared by the controller to more accurately determine and verify the distance between the rollers 382 of the centralizer 285. Sensor 526 may be disposed with in the gripperhead 275 and may be used to determine the distance that the grabber 280 extends or retracts to grab tubulars from a fingerboard (such as fingerboard 155 shown in FIG. 2).

In some implementations, the controller may be configured to determine the position of a tubular with respect to the arms of the grabber 280 and/or gripper 290 based on the measurements (calculated or directly detected) of the distance between the arms of the grabber 280 and/or gripper 290. For example, the controller may receive the measurements from the sensors 502, 506, 520, 522, 524 with regards to the distance between the arms of the grabber 280 and/or gripper 290, as discussed above. An estimated size of tubular may be input into the controller consistent with a drill plan or for individual tubulars. With this information, the controller may calculate the distance between the arms of the grabber 280 and/or the gripper 290 and begin closing the arms. The sensors 502, 506 may be used to verify that the tubular is in the position as expected. For example, if the controller determines that the arms 390, 395 of the grabber 280 need to be closed 3 inches to grip a tubular, the sensors 502, 506 may take proximity measurements as the arms 390, 395 are closed to ensure that the tubular is in contact with the arms 390, 395 after they have been moved 3 inches. If the sensors 502, 506 determine that a tubular is not in contact with the arms 390, 395 after closing them 3 inches, the controller may stop the operation (and reopen the grabber arms 390, 395) to avoid damaging the tubular or grabber 280. The controller may direct the sensors 502, 506, 520, 522, 524 to take new measurements and restart the operation of closing the arms.

In some implementations, the one or more sensors 502, 506, 520, 522, 524 may be used to measure the size of a tubular. This may be accomplished by closing the arms of the grabber 280, gripper 290, and/or centralizer 285 and determining, with the sensors 502, 506 when the arms are in contact with the tubular. The arms may then be stopped and a measurement of the distance between the arms may be taken by the one or more sensors 520, 522, 524. The controller may then correlate this distance to the size of a tubular by using a geometric algorithm.

At a high level, the one or more sensors may be used to measure the size of a tubular by detecting the position of the arms of the grabber 280, the gripper 290, and/or centralizer 285 when measured hydraulic pressure reaches preset limits. For example, as the arms of the grabber 280 close on a tubular, the hydraulic pressure will remain relatively constant until the arms come into contact with the sides of the tubular. After coming into contact with sides of the tubular, the hydraulic pressure will begin to spike upward. Measurements taken when hydraulic pressure spikes will be indicative of the size of the tube. More particularly, when hydraulic pressure spikes, the positions of the arms may be determined by the rig control system 160, and the calculated distance between the arms will be representative of the tubular diameter. Using the same principles, compliance with a preset well plan can also be detected. For example, if the well plan were to call for 5 inch tubulars, the rig control system 160 may be configured to expect a hydraulic pressure spike when the arms of the grabber 280, the gripper 290, and/or the centralizer 285 reach a certain position that would correspond to a 5 inch tubular. The absence of a pressure spike when expected may be indicative of a problem, such as no tubular in the arms or that the tubular is smaller than a 5 inch tubular. Likewise, an early pressure spike would also be indicative of a problem. For example, if the rig control system 160 identified a pressure spike while the arms are 6 inches apart, then the rig control system would know that either the tubular is larger than what is called for by the well plan, or that the tubular is not fully seated between the arms. This is described more fully in the following paragraphs.

Figure 13A:
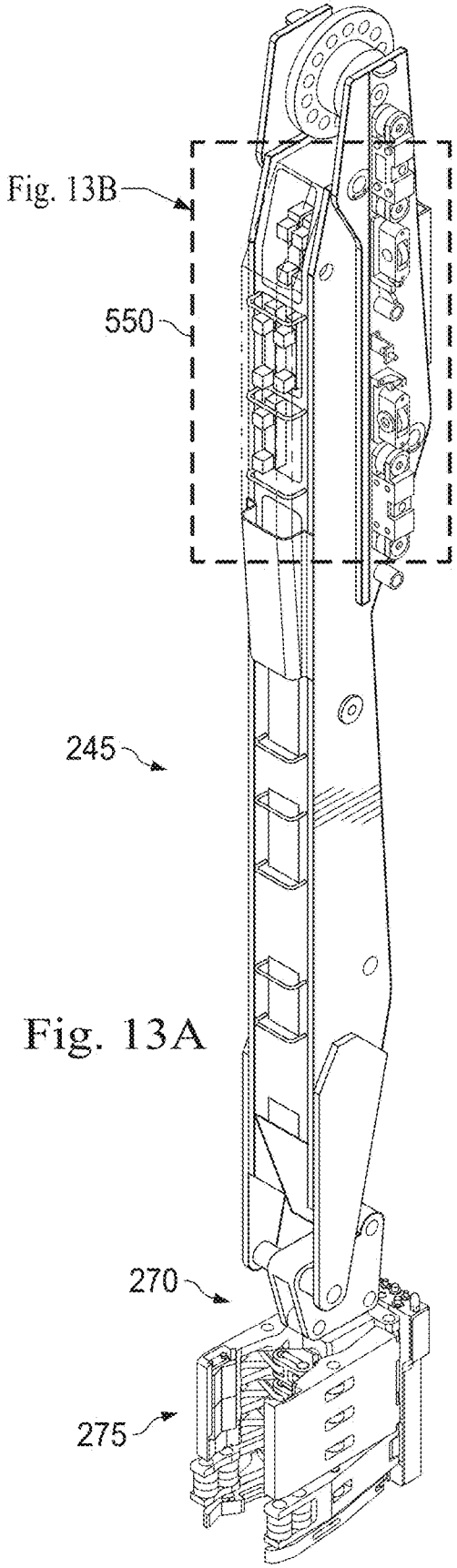
FIG. 13A is a perspective view of a middle arm assembly and gripperhead according to one or more aspects of the present disclosure.
Figure 13B:
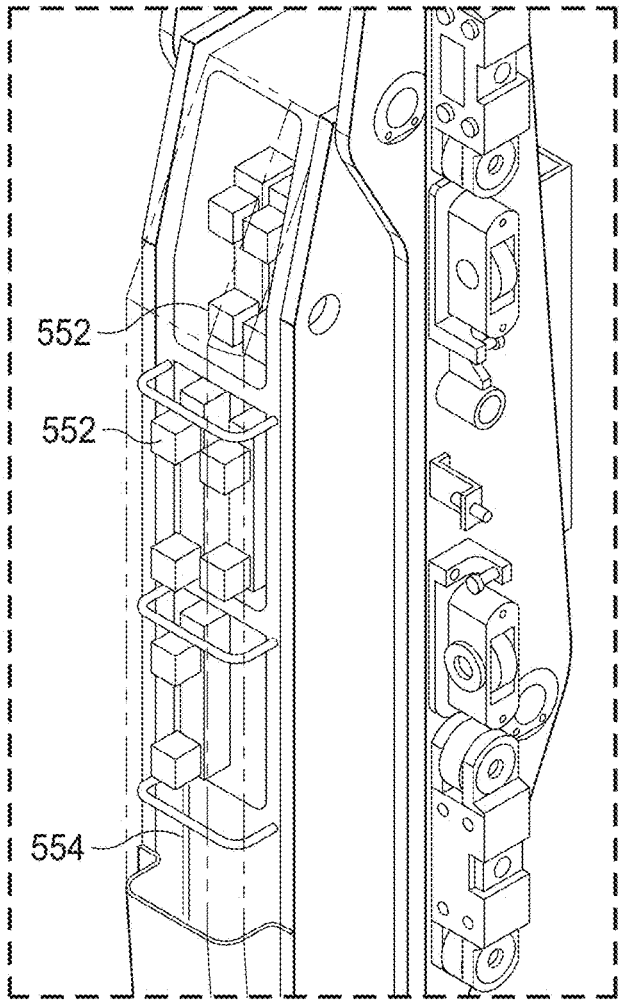
FIG. 13B is a magnified portion of the gripperhead of FIG. 13A according to one or more aspects of the present disclosure.

The one or more sensors 502, 504, 520, 522, 524 may also be configured to verify the compression force of the arms of the grabber 280, gripper 290, and/or centralizer 285 on a tubular. In some implementations, the compression force may be modified to handle different types of objects with the gripperhead systems. For example, the compression force may be set at approximated 2800 psi for tubulars and 1500 psi for casing. The compression force of the grabber 280, gripper 290, and/or centralizer 285 may be modified by adjusting hydraulic switches 552 (FIG. 13A). With reference to FIG. 13B, the hydraulic switches 552 are shown positioned on a magnified upper portion 550 of middle arm assembly 245. The hydraulic switches 552 may be connected to one or more hydraulic lines 554 positioned along the middle arm assembly 245 and connected to the manipulator holder assembly 270. In some implementations, the hydraulic switches 552 are solenoids. The hydraulic switches 552 may be used to increase or decrease the pressure in the hydraulic lines 554 which may correspond to the compression force of the grabber 280, gripper 290, and/or centralizer 285.

In some implementations, the gripperhead 275 includes an electrical system including an electrical connector to provide power to the grabber 280, gripper 290, and/or centralizer 285. The electrical system may be used with the hydraulic system as discussed above, or alternatively, may replace the hydraulic system as a power source. The electrical connector may include a quick connect feature to allow various parts of the gripperhead 275 to be disconnected easily.

Referring again to FIG. 10, the compression force set with the hydraulic switches 552 may be verified by the sensors 502, 504, 520, 522, 524 by comparing the distance between the arms of grabber 280, gripper 290, and/or centralizer 285 to the expected size of a tubular. For example, the arms 390, 395 of the grabber 280 may be closed around a tubular with an outside diameter of 5 inches. The size of the tubular may be determined by the sensors 502, 504, 520, 522, 524 as described above, or alternatively, input into the controller. After the arms 390, 395 are closed around the tubular, the sensors 520, 522, 524 may be used to measure the distance between the arms 390, 395. The difference between this measurement and the size of the tubular may be analyzed by the controller to verify the compression force of the arms 390, 395 and to determine whether the tubular is securely gripped. For example, if the tubular has a diameter of 5 inches and the arms 390, 395 are 4.75 inches apart, the controller may calculate a difference of 0.25 inches, which may represent the amount of deformation of the tubular. This may be unacceptable for some drilling operations, as the tubular may be permanently deformed by the arms 390, 395. In some implementations, an ideal deformation range for a tubular held by the grabber 280 may be 0.1-0.2 inches, as this may show that the tubular is securely gripped by the arms 390, 395 without being permanently deformed. In other implementations, an ideal deformation range may be 0.05-0.1 inches, 0.01-0.3 inches, 0.1-0.5 inches, or other distances. The deformations of tubulars held by the centralizer 285 or gripper 290 may have ideal deformation ranges similar to the grabber 280. In some implementations, an ideal deformation range for casing may be between 0.05 and 0.1 inches, between 0.001 and 0.005 inches, between 0.1 and 0.2 inches, or other distances. If the deformation of the gripped tubular is determined to be outside the ideal deformation range, the controller may direct the grabber 280, gripper 290, and/or centralizer 285 to open and recalculate the distance between the arms. If the distance between the arms of the grabber 280, gripper 290, and/or centralizer 285 is determined to be greater than the diameter of the tubular, the controller may determine that the tubular is not securely grasped. In this case, the controller may be configured to stop the operation and recalculate the size of the tubular.

Referring to FIG. 11, a perspective view of a grabber 280 is shown which may be part of the gripperhead 275. The grabber 280 may include one or more sensors 502, 504. These sensors 502, 504 may be configured to detect and measure tubulars along with a linear actuator or piston 325 disposed in the housing 326. In the example of FIG. 11, the one or more sensors 502, 504 are disposed on both the first grabber arm 390 and the second opposing grabber arm 395 of the grabber 280. Similarly, sensors 502, 504 may be disposed on both arms of the gripper 290 and/or the centralizer. In some implementations, the sensors 502, 504 are proximity sensors configured to determine whether a tubular is very close to or in contact with the arms 390, 395. In some implementations, the sensors 502, 504 are configured to sense nearby ferrous materials.

In the example of FIG. 11, the one or more sensors 502, 504 may be positioned on a top surface of the arms 390, 395. Additionally and/or alternatively, the one or more sensors 502, 504 may be disposed on an inwardly facing gripping surface 391 of the arms 390, 395, on a bottom surface of the arms 390, 395, or within the internal structure of the arms 390, 395. In other implementations, the one or more sensors may be placed on other features of the grabber 280, such as on the link 341 or the pivotable arms 335, 334. As shown in FIG. 11, sensors 502, 506 may also be placed on the arms of other features, such as on the gripper 290. The one or more sensors 502, 504 may be attached to the grabber 280 by one or more bolts 508, as shown in FIG. 10. In other implementations, the one or more sensors 502, 504 are attached to the grabber 280 with an adhesive or other fastening device. As discussed above, the one or more sensors 502, 504 may be connected to a controller, such as the rig control system 160 as shown in reference to FIG. 1. The one or more sensors 502, 504 may communicate with the controller, such as sending and receiving signals from the controller.

Figure 14:
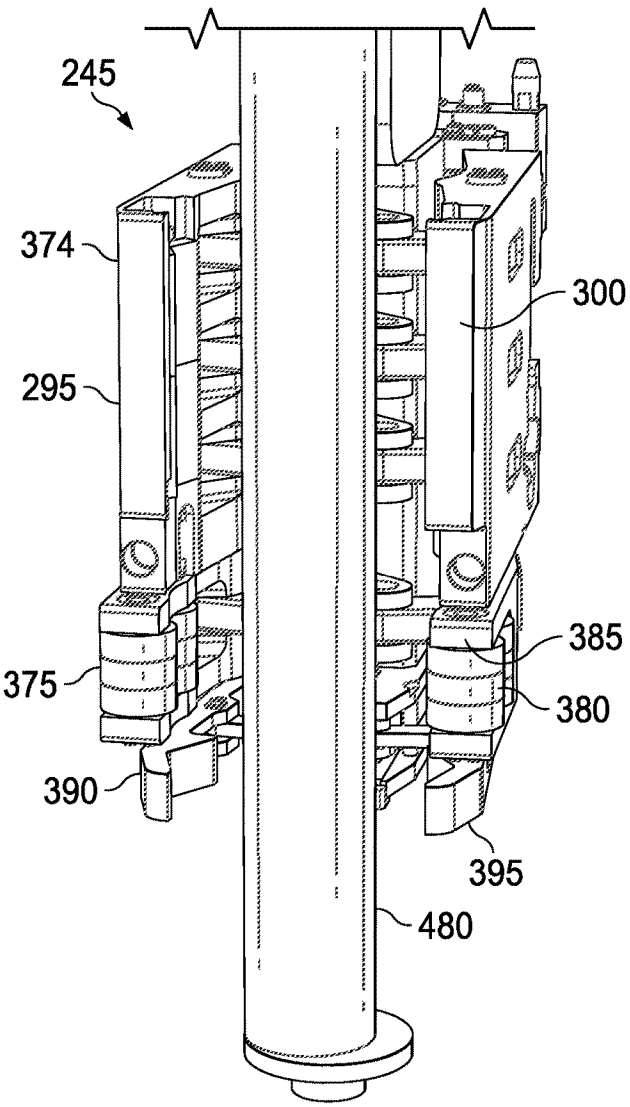

FIG. 12 is a perspective view of the manipulator holder assembly 270 that may be configured to attach to the upper portion of the gripperhead 275. In some implementations, the manipulator holder assembly 270 may include one or more sensors 530 that may be used with the other sensors 502, 504, 506, 520, 522, 524 shown in FIGS. 10-11 to determine a position of a tubular, measure the size of the tubular, verify the compressive force on the tubular, and/or determine whether the tubular is securely grasped. In some implementations the sensors 530 may be ultrasonic sensors. The sensors 530 may be configured to measure the distance of a tubular directly in front of the gripper arm. This measurement may be received by the controller and used to verify that a tubular is grasped by one or more of the grabber 280, gripper 290, and centralizer 285. In the example of FIG. 12, four sensors 530 are shown, although more or less sensors 530 are possible, such as five, three, two, or one sensor 530, as well as other numbers. In some implementations, the sensors 530 are offset slightly from each other to provide a more accurate measurement of the distance between the tubular and the manipulator holder assembly 270. Referring to the FIGS. 14-19, a method of manipulating a tubular using the middle arm assembly 245 includes positioning the middle arm assembly 245 in proximity to a tubular 480. As shown in FIG. 14, and when the middle arm assembly 245 is positioned in proximity to the tubular 480, the gripper arms 295 and 300 are in the open position, the centering arms 375 and 380 are in the open position, and the grabber arms 390 and 395 are in the open position.

In some implementations, positioning the middle arm assembly 245 in proximity to the tubular 480 includes positioning the middle arm assembly 245 in proximity to a fingerboard that accommodates the tubular 480 and another tubular that is spaced from the tubular 480 by a finger 185. The positioning of the middle arm assembly 245 may include measuring the distance between the middle arm assembly 245 and a tubular with one or more sensors, such as ultrasonic sensors 530 as shown in FIG. 12. A controller may receive the measurements from the sensor to determine the location of the tubular in relation to the grabber 280.

Figure 15:
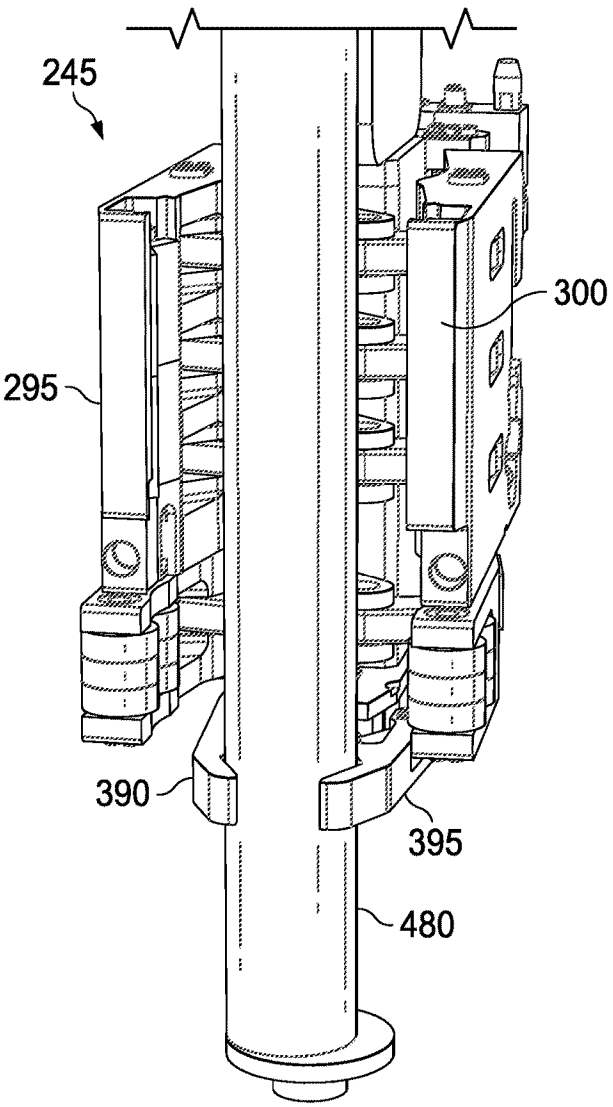
FIGS. 14-19 are perspective views of a gripperhead of and a tubular during steps of a method of operating the gripperhead.

The method may also include extending the grabber arms 390 and 395 in the direction 360 while the grabber arms 390 and 395 are in an open position. As shown in FIGS. 14 and 15, the grabber arms 390 and 395 are moved in the direction 360 to pass beyond the front-most surface 374 of the gripper 290 and the front-most surface 385 of the centralizer 285.

The method may also include measuring the distance between the gripper arms 295, 300 and the grabber arms 390, 395 to ensure that the tubular is positioned correctly. In some implementations, one or more sensors 502, 504, 506

520, 522, 524 are disposed on the gripper arms 295, 300, and/or grabber arms 390, 395 (as shown in FIGS. 10 and 11) as well as within other features, such as within pistons 325. The sensors 502, 504, 506 may be proximity sensors (which may be disposed on the arms) and sensors 520, 522, 524 may be inductive sensors (which may be disposed within or near the pistons 325) including LVDTs. Using the sensors, 502, 504, 506, 520, 522, 524, the distance of the gripper arms 295, 300 and the grabber arms 390, 395, as well as the distance between the tubular and the gripper arms 295, 300 and the grabber arms 390, 395 may be determined. In some implementations, this step may include measuring the diameter of the pipe with the sensors 502, 504, 506.

The method may also include closing the grabber arms 390 and 395 to secure the tubular 480 within the grabber arms 390 and 395. The pressure of the gripper arms 295, 300 and/or grabber arms 390, 395 may be measured by the sensors 502, 504, 506 as they are closed to ensure that the tubular is securely gripped and to avoid crushing the tubular. In some implementations, the sensors 502, 504, 506, 520, 522, 524 may be used to verify that the compression force of the gripper and/or grabber is within acceptable limits. This step may include comparing the measured distance between the arms to the size of a tubular and verifying that a tubular is in contact with the arms using proximity sensors 502, 504, 506. These determinations may be made by the controller after receiving sensor data. Instructions to continue or stop the steps of the method may be sent by the controller based on the determinations.

Figure 17:
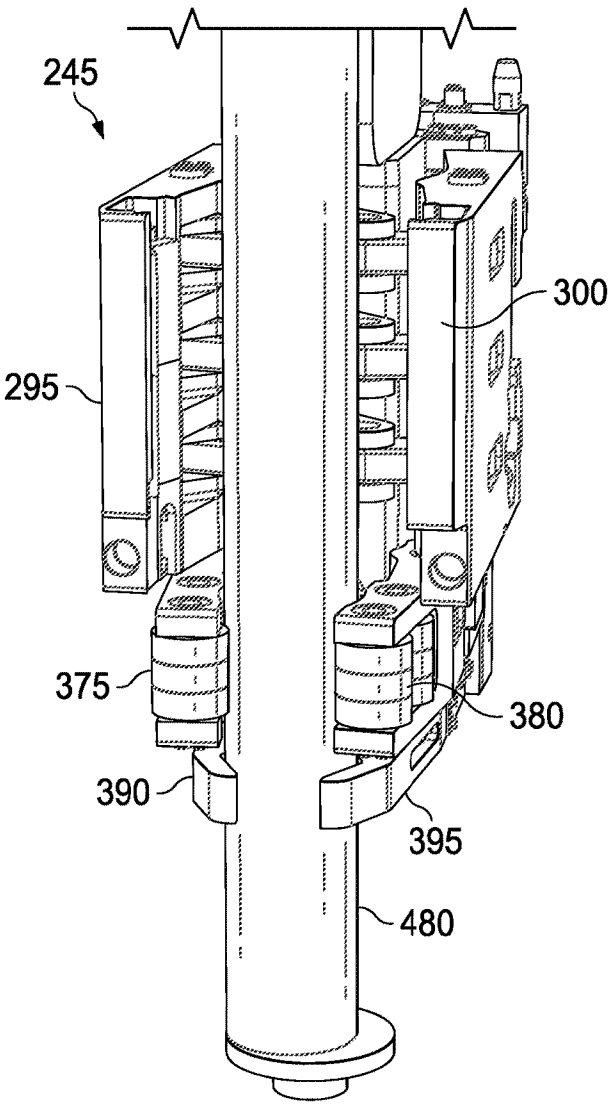
Figure 16:
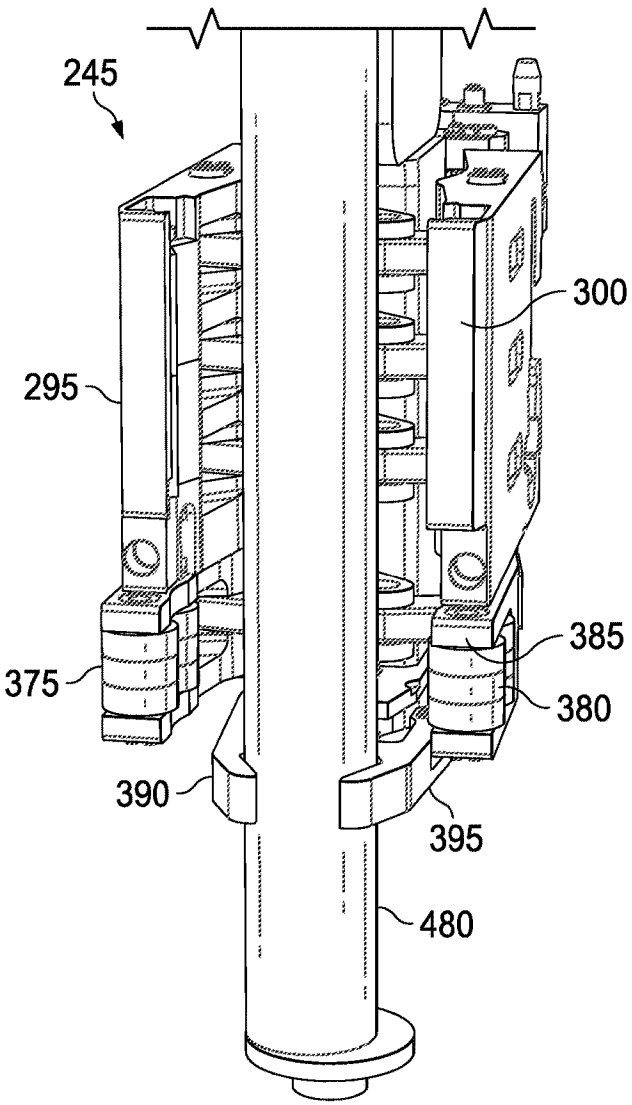
Figure 19:
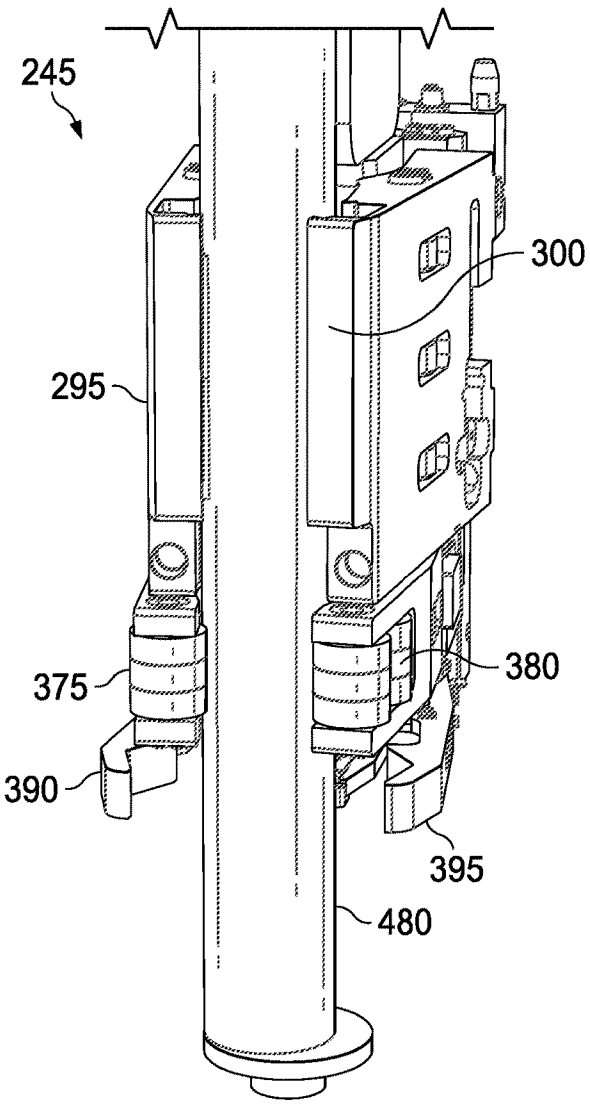
Figure 18:
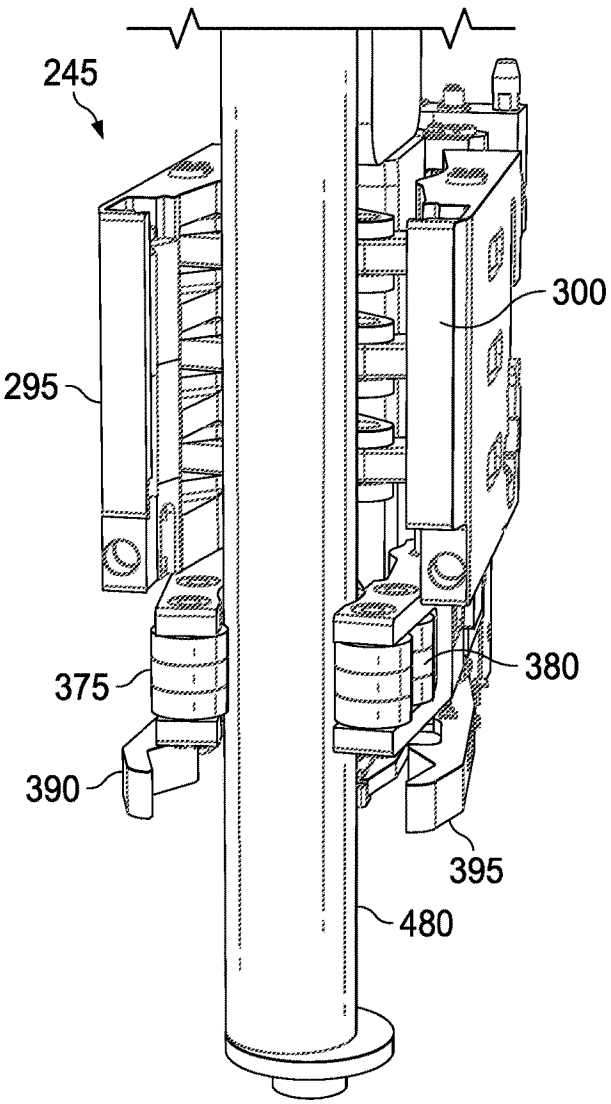

As shown in FIG. 16, the method may also include pulling the tubular 480 towards the centralizer 285 and the gripper 290 in the direction 355. As shown in FIG. 17, the method may include closing the centering arms 375 and 380 of the centralizer 285 to center the tubular 480 relative to the centralizer 285 and the gripper 290. Centering the tubular 480 relative to the centralizer 285 may include aligning a longitudinal axis of the tubular 480 and the longitudinal axis of the generally cylindrical chamber formed by the gripper arms 295 and 300. Centering the tubular 480 may include verifying the position of the tubular with sensors 502, 504, 506, 520, 522, 524, 526, 530. In some implementations, the tubular 480 is allowed to rotate while secured in the centralizer 285. This may allow the makeup and breakdown of tubulars by threading tubulars together. In these circumstances, the tubular may be held only by the centralizer 285. As shown in FIG. 18, the method also includes opening the grabber arms 390 and 395 while the tubular is secured in the closed centering arms 375 and 380. The method may also include, as shown in FIG. 19, closing the gripper arms 295 and 300 to secure the tubular 480 prior to moving or otherwise manipulating the tubular 480. When the tubular 480 is secured and/or suspended in the gripper arms 295, 300, the middle arm assembly 245 of the racker device can move the tubular 480 from vertical to horizontal or from horizontal to vertical. The method can also be performed in reverse to release the tubular 480 that is secured in the gripper arms 295 and 300. During the step shown in FIG. 19, the sensors 502, 504, 506, 520, 522, 524 may be used to verify that the tubular 480 is securely gripped by the gripper and grabber, as discussed above. In some implementations, the sensors 502, 504, 506, 520, 522, 524 may be used to determine that the tubular 480 is not moving, such as making proximity measurements over a period of time and ensuring that the distance between the tubular 480 and grabber 280 and/or gripper 290 does not change.

In the exemplary implementations described herein, the grabber 280, the centralizer 285, and the gripper 290 each operate independently of each other. That is, the centralizer 285 may be closed while the gripper 290 and the grabber 280 are open. Similarly, the gripper 290 may be closed while the centralizer 285 and the grabber 280 are open. As described below, the grabber 280 may be closed and may manipulate a tubular into the chamber of the gripperhead while the centralizer 285 and gripper 290 are open.

In some implementations, the type or size of tubular that is being manipulated by the middle arm assembly 245 changes. As such, the outer diameter of the tubular changes. These changes may be programmed into the system or detected automatically by the one or more sensors 502, 504, 506, 520, 522, 524, 526. In response, the gripperhead 275 may be changed to accommodate the change in outer diameter of the tubular. Thus, a variety of gripperheads 275, each sized to accommodate a size or range of sizes of tubulars, may be installed or removed from the manipulator holder assembly 270. Due to the self-aligning coupler and hydraulic quick connects, the average time to change a gripperhead is about 5 minutes-compared to hours using conventional gripperheads. As such, the gripperhead 275 a modular gripperhead 275 that allows for the quick and efficient changing of the gripperhead 275.

Generally, each of the axes 310, 330, and 445 is perpendicular to each of the other axes 310, 330, and 445. In one implementation, the gripper 290, is located above the centralizer 285 in the direction 475, the centralizer 285 is located above the grabber 280 in the direction 475, and the hydraulic manifold assembly 277 is located beside, along the axis 310, each of the gripper 290, the centralizer 285, and the grabber 280. However, a variety of arrangements are contemplated herein.

The interfacing connection between the manipulator holder assembly 270 and the gripperhead 275 is selectively attachable so that during operation they are fixed together, yet can be disconnected from each other so that the gripperhead 275 may be quickly removed and replaced.

While the modules described herein have certain components associated therewith, it should be understand that the modules may be arranged so that different components form a part of different modules.

In view of all of the above and the figures, one of ordinary skill in the art will readily recognize that the present disclosure provides for an apparatus for grasping tubulars, comprising: a grabber assembly including a first grabber arm and a second opposing grabber arm, each grabber arm having an inwardly facing gripping surface that forms at least a portion of a chamber sized to receive a portion of a cylindrical tubular; and a set of sensors comprising a first sensor disposed on the grabber assembly and configured to determine a position of the cylindrical tubular within the chamber.

In some implementations, the apparatus includes a linear actuator connected to the first and second grabber arms, the linear actuator configured to control actuation of the grabber assembly, wherein the first sensor is disposed within the linear actuator. The first sensor may be configured to determine a distance between the first grabber arm and the second opposing grabber arm. The first sensor may be an inductive sensor. The first sensor may be a linear variable differential transducer (LVDT).

In some implementations, the set of sensors comprises a second sensor disposed on the first grabber arm. The second sensor may be a proximity sensor. The apparatus may include a manipulator arm, wherein the set of sensors comprises a third sensor disposed on the manipulator arm. The third sensor may be an ultrasonic sensor. The apparatus may include a controller in communication with the set of sensors, the controller configured to receive input from the first and third sensors and determine the position of the cylindrical tubular within the chamber based on the input from the first and third sensors. The apparatus may include a first and second gripper arm, with each gripper arm being displaceable in a direction along a first axis that is transverse to a longitudinal axis between a retracted position and an extended position.

In some implementations, the apparatus further include: a centralizer arranged to manipulate a tubular held by the first and second grabber arms or the first and second gripper arms, the centralizer comprising a first centering arm and an opposing second centering arm, each centering arm positioned to pivot about a third and fourth pivot point, respectively, and between an open position sized to permit a portion of a cylindrical tubular to enter the chamber and a closed position sized to secure a portion of a cylindrical tubular in the chamber.

A modular gripperhead is also provided, which may include: a grabber comprising a first grabber arm, a second opposing grabber arm, and a first linear actuator connected to the first and second grabber arms, each grabber arm having an inwardly facing gripping surface that forms at least a portion of a chamber sized to receive a portion of a cylindrical tubular, wherein the portion of the chamber has a longitudinal axis; a gripper comprising a first gripper arm and a second opposing gripper arm, wherein each of the first and second gripper arms is pivotable about a first and second pivot point, respectively, and between an open position sized to permit a portion of a cylindrical tubular to enter the chamber and a closed position sized to secure a portion of a cylindrical tubular in the chamber; and a first sensor disposed on the grabber and configured to determine the position of the cylindrical tubular within the chamber.

In some implementations, the first sensor is an inductive sensor. The first sensor may be a linear variable differential transducer (LVDT). The first sensor may be disposed within the first linear actuator and configured to measure a distance between the first and second gripper arms. A second sensor may be disposed on one of the first and second gripper arms. The second sensor may be a proximity sensor configured to detect whether the first or second grabber arm is in contact with a cylindrical tubular.

In some implementations, each of the first and second grabber arms is hydraulically actuated; each of the first gripper arm and the second opposing gripper arms is hydraulically actuated; the modular gripperhead also comprises a hydraulic manifold assembly that is configured to actuate each of the first grabber arm, the second grabber arm, the first gripper arm, and the second opposing gripper arm; the hydraulic manifold assembly comprises a plurality of quick connect couplers that corresponds with each of the first and second grabber arms and the first and second gripper arms; and the plurality of quick connect couplers are on a top surface of the hydraulic manifold assembly.

In some implementations, the modular gripperhead comprises an electrical connector configured to connect the modular gripperhead to a power source.

A method of manipulating a tubular is also provided, the method including: positioning a grabber assembly in proximity to the tubular, the grabber assembly comprising a linear actuator connected to a first grabber arm and a second opposing grabber arm, each grabber arm having an inwardly facing gripping surface that forms at least a portion of a generally cylindrically chamber, wherein the portion of the generally cylindrically chamber has a longitudinal axis; determining, with a set of sensors disposed on the grabber assembly, a position of the tubular within the cylindrical chamber; and closing the first and second grabber arms to secure the tubular between the first and second grabber arms.

In some implementations, the method further includes calculating, with a controller connected to the set of sensors, a distance between the first grabber arm and the second opposing grabber arm. The method may include calculating, with the controller, a size of a tubular positioned within the generally cylindrical chamber based on the calculation of the distance between the first grabber arm and the second opposing grabber arm. The method may include measuring, with the set of sensors, a deformation of the tubular after closing the first and second grabber arms to secure the tubular between the first and second grabber arms. The method may include verifying, with a proximity sensor of the set of sensors, that the tubular is secured by the grabber assembly.

In some implementations, the positioning a grabber assembly in proximity to the tubular includes measuring, with one or more ultrasonic sensors, the position of a tubular in front of the grabber assembly. The method may include measuring, with the set of sensors, a pressure measurement to avoid crushing the tubular. The method may include verifying, with the pressure measurement, that the tubular is secured by the grabber assembly.

The foregoing outlines features of several implementations so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the implementations introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. § 112(f) for any limitations of any of the claims herein, except for those in which the claim expressly uses the word "means" together with an associated function.

What is claimed is:

1. An apparatus for grasping tubulars, comprising:

a grabber assembly including a first grabber arm and a second opposing grabber arm, each grabber arm having an inwardly facing gripping surface that forms at least a portion of a chamber sized to receive a portion of a cylindrical tubular, wherein the grabber is arranged so that each of the first grabber arm and the second grabber arm are sized to fit between tubulars in adjacent rows of a fingerboard and the first grabber arm and the second grabber arm are laterally adjustable in a lateral direction to change a distance between the first grabber arm and the second grabber arm, and wherein the first grabber arm is disposed relative to the second grabber arm so the first grabber arm and the second grabber arm are adjustable in a direction transverse to the lateral direction, and the grabber assembly is arranged to manipulate a tubular into the chamber so that a gripper can grip the tubular;

a set of sensors comprising a first sensor disposed on the grabber assembly and configured to determine a position of the cylindrical tubular within the chamber; and a linear actuator connected to the first and second grabber arms, the linear actuator configured to control actuation of the grabber assembly, wherein the first sensor is disposed within the linear actuator and configured to verify that a tubular held by the grabber is aligned with an axis of the chamber so that the gripper can grip the tubular.

2. The apparatus of claim 1, wherein the first sensor is configured to determine the distance between the first grabber arm and the second opposing grabber arm.

3. The apparatus of claim 1, wherein the first sensor is an inductive sensor.

4. The apparatus of claim 1, wherein the first sensor is a linear variable differential transducer (LVDT).

5. The apparatus of claim 1, wherein the set of sensors comprises a second sensor disposed on the first grabber arm.

6. The apparatus of claim 5, wherein the second sensor is a proximity sensor.

7. The apparatus of claim 1, further comprising a manipulator arm, wherein the set of sensors comprises a third sensor disposed on the manipulator arm.

8. The apparatus of claim 7, wherein the third sensor is an ultrasonic sensor.

9. The apparatus of claim 7, further comprising a controller in communication with the set of sensors, the controller configured to receive input from the first and third sensors and determine the position of the cylindrical tubular within the chamber based on the input from the first and third sensors.

10. The apparatus of claim 1, further comprising a first and a second gripper arm, with each gripper arm being displaceable in a direction along a first axis that is transverse to a longitudinal axis between a retracted position and an extended position.

11. The apparatus of claim 10, further comprising:

a centralizer arranged to manipulate a tubular held by the first and second grabber arms or the first and second gripper arms, the centralizer comprising a first centering arm and an opposing second centering arm, each centering arm positioned to pivot about a third and fourth pivot point, respectively, and between an open position sized to permit a portion of a cylindrical tubular to enter the chamber and a closed position sized to secure a portion of a cylindrical tubular in the chamber.

12. A modular gripperhead for use with a drilling rig apparatus, the modular gripperhead comprising:

a grabber comprising a first grabber arm, a second opposing grabber arm, and a first linear actuator connected to the first and second grabber arms, each grabber arm having an inwardly facing gripping surface that forms at least a portion of a chamber sized to receive a portion of a cylindrical tubular, wherein the portion of the chamber has a longitudinal axis, wherein the grabber is arranged so that each of the first grabber arm and the second grabber arm are sized to fit between tubulars in adjacent rows of a fingerboard disposed on the drilling rig apparatus and the first grabber arm and the second grabber arm are laterally adjustable in a lateral direction to change a distance between the first grabber arm and the second grabber arm, and wherein the first grabber arm is disposed relative to the second grabber arm so the first grabber arm and the second grabber arm are adjustable in a direction transverse to the lateral direction;

a gripper comprising a first gripper arm and a second opposing gripper arm, wherein each of the first and second gripper arms is pivotable about a first and second pivot point, respectively, and between an open position sized to permit a portion of the cylindrical tubular to enter the chamber and a closed position sized to secure a portion of the cylindrical tubular in the chamber, wherein the grabber is arranged to manipulate a tubular into the chamber so that the gripper can grip the tubular; and a first sensor disposed on the grabber and configured to determine the position of the cylindrical tubular within the chamber and verify that a tubular held by the grabber is aligned with an axis of the chamber so that the gripper can grip the tubular.

13. The modular gripperhead of claim 12, wherein the first sensor is an inductive sensor.

14. The modular gripperhead of claim 12, where in the first sensor is a linear variable differential transducer (LVDT).

15. The modular gripperhead of claim 12, wherein the first sensor is configured to measure a distance between the first and second gripper arms.

16. The modular gripperhead of claim 12, further comprising a second sensor disposed on one of the first and second gripper arms.

17. The modular gripperhead of claim 16, wherein the second sensor is a proximity sensor configured to detect whether the first or second grabber arm is in contact with the cylindrical tubular.

18. The modular gripperhead of claim 12, wherein each of the first and second grabber arms is hydraulically actuated;

wherein each of the first gripper arm and the second opposing gripper arms is hydraulically actuated;

wherein the modular gripperhead also comprises a hydraulic manifold assembly that is configured to actuate each of the first grabber arm, the second grabber arm, the first gripper arm, and the second opposing gripper arm;

wherein the hydraulic manifold assembly comprises a plurality of quick connect couplers that corresponds with each of the first and second grabber arms and the first and second gripper arms; and wherein the plurality of quick connect couplers are on a top surface of the hydraulic manifold assembly.

19. The modular gripperhead of claim 12, wherein the modular gripperhead comprises an electrical connector configured to connect the modular gripperhead to a power source.

20. The modular gripperhead of claim 12, wherein the gripper is configured to apply a sufficient force to the cylindrical tubular to hoist and otherwise manipulate the cylindrical tubular.

21. A method of manipulating a tubular, the method comprising:

positioning a grabber assembly gripperhead in proximity to the tubular, the grabber assembly comprising a linear actuator connected to a first grabber arm and a second opposing grabber arm, each grabber arm having an inwardly facing gripping surface that forms at least a portion of a generally cylindrically chamber; wherein the portion of the generally cylindrically chamber has a longitudinal axis;

determining, with a set of sensors disposed on the grabber assembly, a position of the tubular within the cylindrical chamber;

closing the first and second grabber arms to secure the tubular between the first and second grabber arms; and calculating, with a controller connected to the set of sensors, a distance between the first grabber arm and the second opposing grabber arm.

22. The method of claim 21, further comprising calculating, with the controller, a size of a tubular positioned within the generally cylindrical chamber based on the calculation of the distance between the first grabber arm and the second opposing grabber arm.

23. The method of claim 21, further comprising verifying, with a proximity sensor of the set of sensors, that the tubular is secured by the grabber assembly.

24. The method of claim 21, wherein the positioning a grabber assembly in proximity to the tubular includes measuring, with one or more ultrasonic sensors, the position of a tubular in front of the grabber assembly.

25. A method of manipulating a tubular, the method comprising:

positioning a grabber assembly gripperhead in proximity to the tubular, the grabber assembly comprising a linear actuator connected to a first grabber arm and a second opposing grabber arm, each grabber arm having an inwardly facing gripping surface that forms at least a portion of a generally cylindrically chamber, wherein the portion of the generally cylindrically chamber has a longitudinal axis;

determining, with a set of sensors disposed on the grabber assembly, a position of the tubular within the cylindrical chamber;

closing the first and second grabber arms to secure the tubular between the first and second grabber arms; and measuring, with the set of sensors, a deformation of the tubular after closing the first and second grabber arms to secure the tubular between the first and second grabber arms.

26. A method of manipulating a tubular on a drilling rig apparatus, the method comprising:

positioning a grabber assembly in proximity to the tubular, the grabber assembly comprising a linear actuator connected to a first grabber arm and a second opposing grabber arm, each grabber arm having an inwardly facing gripping surface that forms at least a portion of a generally cylindrically chamber; wherein the portion of the generally cylindrically chamber has a longitudinal axis alignable with a tubular, wherein the grabber assembly is arranged so that the first grabber arm and the second grabber arm are sized to fit between tubulars in adjacent rows of a fingerboard of the drilling rig apparatus and the first grabber arm and the second grabber arm are laterally adjustable in a lateral direction to change a distance between the first grabber arm and the second grabber arm, and wherein the first grabber arm is disposed relative to the second grabber arm so the first grabber arm and the second grabber arm are adjustable in a direction transverse to the lateral direction, and the grabber assembly is arranged to manipulate a tubular into the chamber so that a gripper can grip the tubular;

determining, with a set of sensors disposed on the grabber assembly, a position of the tubular within the cylindrical chamber and verifying that a tubular held by the grabber is aligned with an axis of the chamber so that the gripper can grip the tubular;

closing the first and second grabber arms to secure the tubular between the first and second grabber arms; and measuring, with the set of sensors, a pressure measurement to avoid crushing the tubular.

27. The method of claim 26, further comprising verifying, with the pressure measurement, that the tubular is secured by the grabber assembly.

* * * * *